US009746829B2

(12) United States Patent
Stranczl et al.

(10) Patent No.: US 9,746,829 B2
(45) Date of Patent: Aug. 29, 2017

(54) CONTACTLESS CYLINDER ESCAPEMENT MECHANISM FOR TIMEPIECES

(71) Applicant: NIVAROX-FAR S.A., Le Locle (CH)

(72) Inventors: Marc Stranczl, Nyon (CH); Pascal Winkler, Marin (CH); Gianni Di Domenico, Neuchatel (CH); Jean-Luc Helfer, Le Landerson (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/106,433

(22) PCT Filed: Dec. 8, 2014

(86) PCT No.: PCT/EP2014/076930

§ 371 (c)(1),
(2) Date: Jun. 20, 2016

(87) PCT Pub. No.: WO2015/096973

PCT Pub. Date: Jul. 2, 2015

(65) Prior Publication Data

US 2017/0003653 A1 Jan. 5, 2017

(30) Foreign Application Priority Data

Dec. 23, 2013 (CH) ..... 2140/13
Dec. 23, 2013 (EP) ..... 13199427
(Continued)

(51) Int. Cl.
*G04B 15/00* (2006.01)
*G04B 15/14* (2006.01)
*G04C 5/00* (2006.01)

(52) U.S. Cl.
CPC ..... *G04B 15/14* (2013.01); *G04B 15/00* (2013.01); *G04C 5/005* (2013.01)

(58) Field of Classification Search
CPC ..... G04B 15/00; G04B 15/06; G04B 15/08; G04B 15/14; G04C 5/00; G04C 5/005
See application file for complete search history.

(56) References Cited

U.S. PATENT DOCUMENTS 3,183,426 A 5/1965 Haydon
3,208,287 A * 9/1965 Ishikawa ..... G04C 5/005 368/126

(Continued)

FOREIGN PATENT DOCUMENTS

GB 671 360 A 5/1952

OTHER PUBLICATIONS

International Search Report issued Jul. 23, 2015, in PCT/EP2014/076930 filed Dec. 8, 2014.

*Primary Examiner* — Vit M Miska
(74) *Attorney, Agent, or Firm* — Oblon, McClelland, Maier & Neustadt, L.L.P.

(57) ABSTRACT

An escapement mechanism including an escape wheel subjected to a rotational torque and a resonator integral with a pivotally mounted regulating wheel set. The escape wheel includes plural actuators regularly spaced on a periphery thereof, each arranged to cooperate directly with at least a first track of the regulating wheel set. Each actuator includes a first magnetically, or respectively electrically charged, or ferromagnetic or respectively electrostatically conductive surface, to cooperate with the first track which is magnetically, or respectively electrically charged, or ferromagnetic or respectively electrostatically conductive, to repel or attract each first surface of the actuator, and each actuator includes a mechanical stop member to cooperate, in an end-of-travel stop arrangement, with at least a first complementary stop surface included in the regulating wheel set to constitute therewith an autonomous escapement mechanism.

28 Claims, 17 Drawing Sheets

(30) Foreign Application Priority Data

| | | |
|---|---|---|
| Jul. 11, 2014 | (CH) | 1057/14 |
| Jul. 11, 2014 | (EP) | 14176816 |
| Sep. 19, 2014 | (CH) | 1416/14 |
| Sep. 19, 2014 | (EP) | 14185638 |
| Sep. 24, 2014 | (EP) | 14186261 |

(56) References Cited

U.S. PATENT DOCUMENTS

| | | | | | |
|---|---|---|---|---|---|
| 3,410,083 | A | * | 11/1968 | Korr | G04C 5/005<br>368/126 |
| 3,609,958 | A | * | 10/1971 | Bertsch | G04C 5/005<br>310/37 |
| 3,690,191 | A | * | 9/1972 | Ott | F16H 31/00<br>310/21 |

* cited by examiner

CONTACTLESS CYLINDER ESCAPEMENT MECHANISM FOR TIMEPIECES

CROSS-REFERENCE TO RELATED APPLICATIONS

This is a National Phase Application in the United States of International Patent Application PCT/EP2014/076930 filed Dec. 8, 2014 which claims priority on Swiss Patent Application No. 02140/13 of Dec. 23, 2013, European Patent Application No. 13199427.9 of Dec. 23, 2013, Swiss Patent Application No. 01057/14 of Jul. 11, 2014, European Patent Application No. 14176816.8 of Jul. 11, 2014, Swiss Patent Application No. 01416/14 of Sep. 19, 2014, European Patent Application No. 14185638.5 of Sep. 19, 2014, European Patent Application No. 14186261.5 of Sep. 24, 2014, the entire contents of each of which are herein incorporated by reference.

FIELD OF THE INVENTION

The invention concerns a timepiece escapement mechanism, comprising an escape wheel subjected to a rotational torque, having a lower or equal moment to a nominal moment, about a first pivot axis, and a resonator integral with a regulating wheel set mounted to pivot about a second real or virtual pivot axis, said escape wheel comprising a plurality of actuators regularly spaced on its periphery and each arranged to cooperate directly with at least a first track of said regulating wheel set.

The invention also concerns a timepiece movement comprising at least one such escapement mechanism, and comprising drive motor means subjecting a said escape wheel to a unidirectional rotational torque about a first pivot axis.

The invention also concerns a timepiece including one such movement.

The invention concerns the field of timepiece escapement mechanisms, and more specifically the field of contactless escapement mechanisms.

BACKGROUND OF THE INVENTION

The cylinder escapement is satisfactory from the point of view of safety, but it has two significant weak points:

it is not a detached escapement, i.e. one of the teeth of the escape wheel is constantly in contact, and therefore in friction, with the balance wheel. This friction disrupts the oscillations, reduces the efficiency of the escapement and impairs chronometric properties;

it is not a constant force escapement. The energy transmitted to the balance wheel depends on the torque from the escape wheel.

SUMMARY OF THE INVENTION

The invention proposes to adapt the principle of the mechanical cylinder escapement, which has the advantage of ensuring safety in the event of excessive torque, notably following a shock, but whose high friction level significantly impairs the efficiency of the escapement.

The invention is based on the principle of eliminating contact and friction in a cylinder escapement, by the introduction of magnets, or of electrets, or suchlike, which, when properly placed, form a magnetic or electrostatic repulsion, which eliminates friction and thus the main flaw of this escapement. The magnets, or suchlike, placed on the escape wheel, act as contactless stop members. Mechanical stop members are added to prevent the escape wheel racing in the event of shock.

The fact of combining a contactless system with mechanical safety elements is an important feature of the invention.

To this end, the invention concerns a timepiece escapement mechanism, comprising an escape wheel subjected to a rotational torque, having a lower or equal moment to a nominal moment, about a first pivot axis, and a resonator integral with a regulating wheel set mounted to pivot about a second real or virtual pivot axis, said escape wheel comprising a plurality of actuators regularly spaced on its periphery and each arranged to cooperate directly with at least a first track of said regulating wheel set, characterized in that each said actuator includes first magnetic or electrostatic stopping means forming a barrier, and arranged to cooperate with said first track which is magnetically, or respectively electrically charged, or ferromagnetic, or respectively electrostatically conductive, to exert on said first track a torque having a moment greater than said nominal moment, and further characterized in that each said actuator also includes second stopping means arranged to form an end-of-travel stop, arranged to form an autonomous escapement mechanism with at least a first complementary stop surface comprised in said regulating wheel set.

The invention also concerns a timepiece movement comprising at least one such escapement mechanism, and comprising drive motor means subjecting a said escape wheel to a unidirectional rotational torque about a first pivot axis, characterized in that said drive motor means are arranged to deliver a torque sufficient to allow the complete superposition of each said first surface with said first track.

The invention also concerns a timepiece including one such movement.

BRIEF DESCRIPTION OF THE DRAWINGS

Other features and advantages of the invention will appear upon reading the following detailed description, with reference to the annexed drawings, in which:

FIG. 5 shows an overall plan view, FIG. 6 a side view, FIG. 6A a top view, with the first magnetic track cooperating with the magnetized ring, and FIG. 7 shows a perspective view in the same position as FIG. 6A.

DETAILED DESCRIPTION OF PREFERRED EMBODIMENTS

Figure 1:
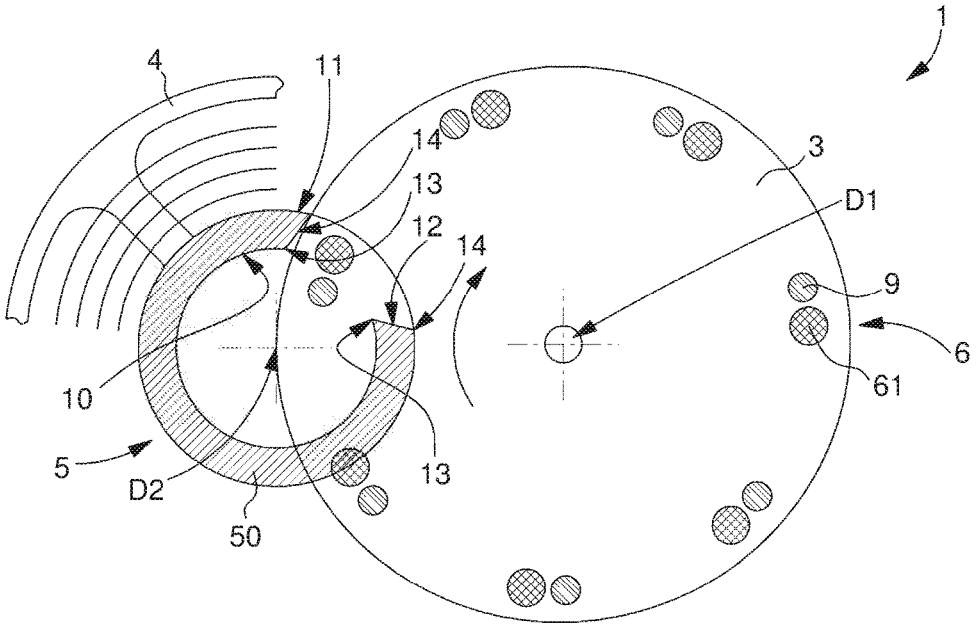
FIG. 1 shows a partial schematic plan view of an escapement mechanism according to the invention, in a magnetic alternative, wherein an escape wheel, equipped with particular actuators at the periphery thereof, each comprising magnetic tracks and a mechanical stop member, cooperates with a balance wheel having a roller carrying a regulating wheel set that includes a truncated cylindrical ring which is magnetized parallel to the pivot axis of the balance.
Figure 2:
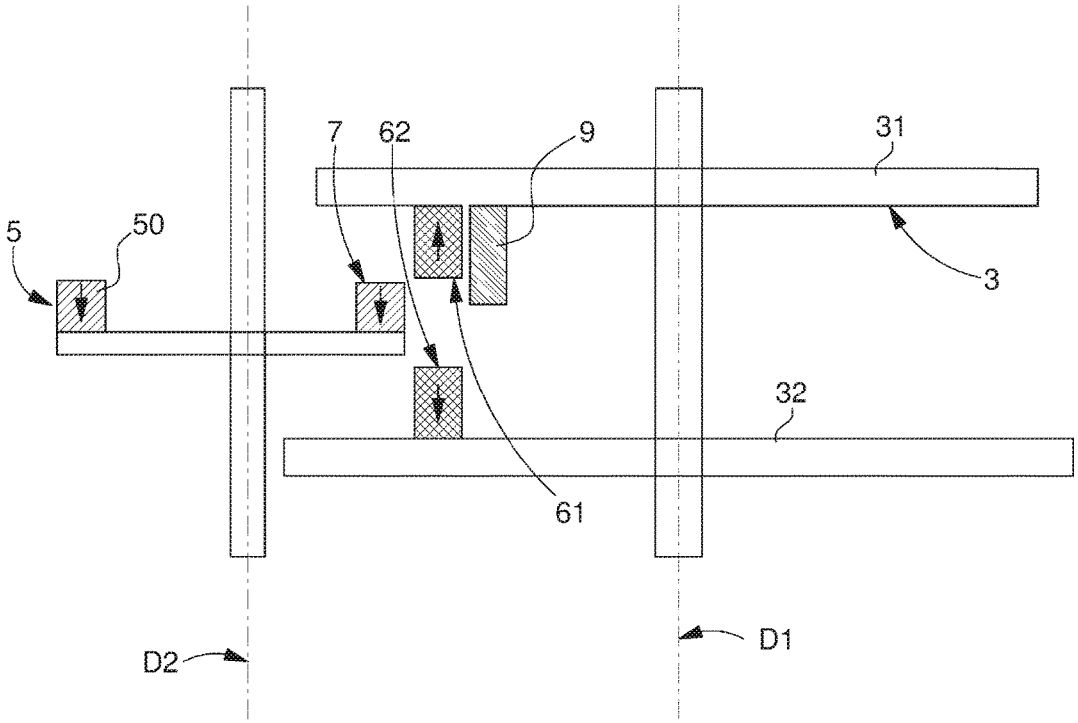
FIG. 2 shows the mechanism of FIG. 1 in a schematic cross-sectional view passing through the pivot axes of the balance and of the escape wheel.
Figure 3:
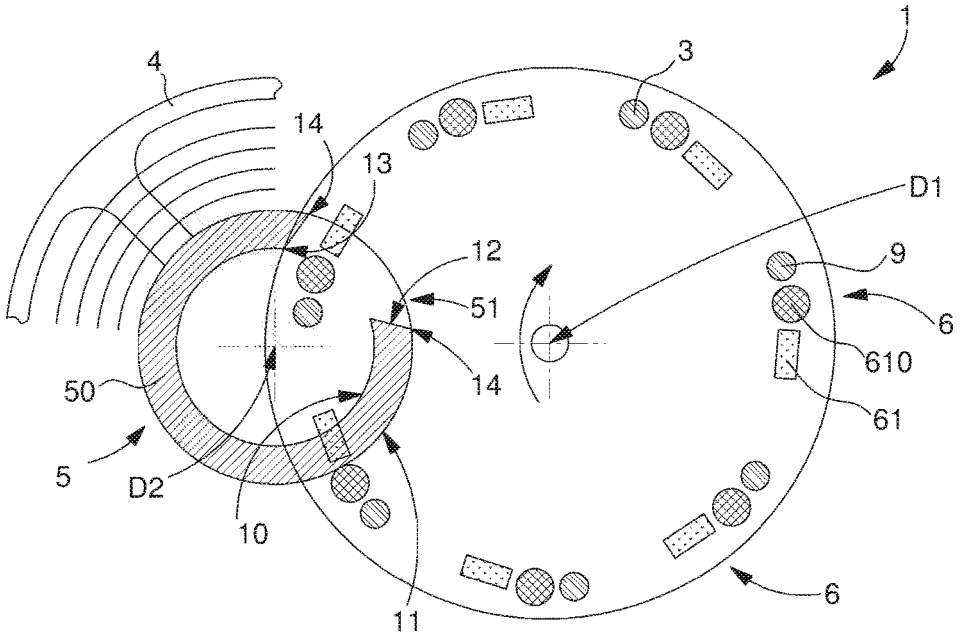
FIGS. 3 and 4 represent, in a similar fashion to FIGS. 1 and 2, the cooperation of a first magnetic surface of an actuator with the ring.
Figure 4:
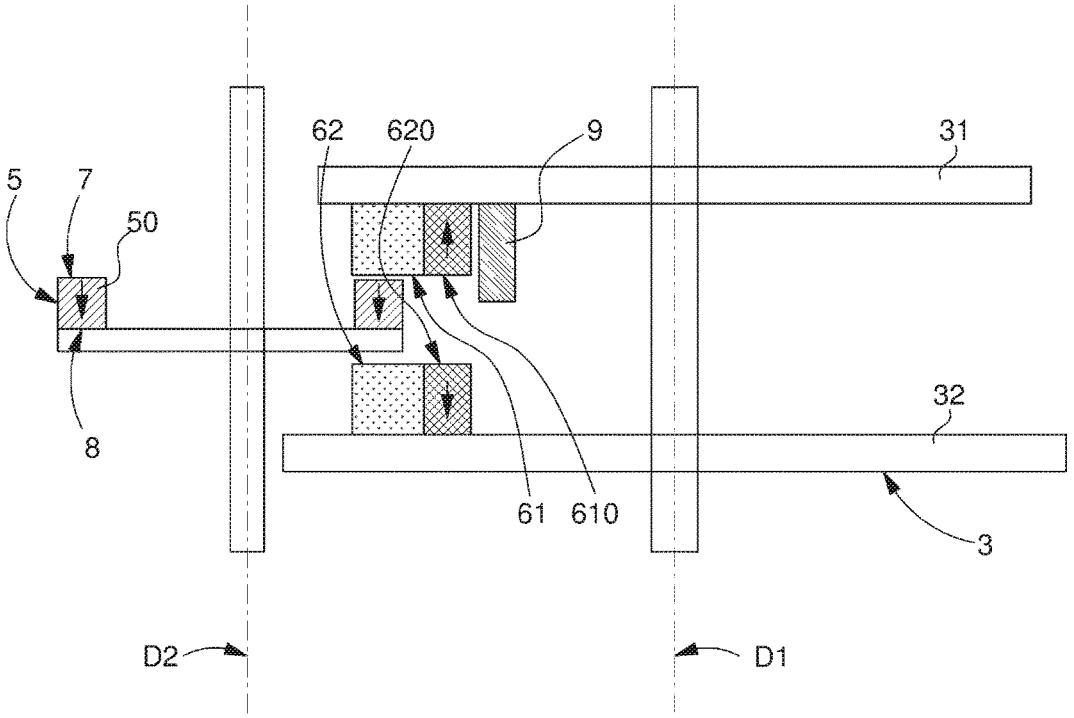
Figure 5:
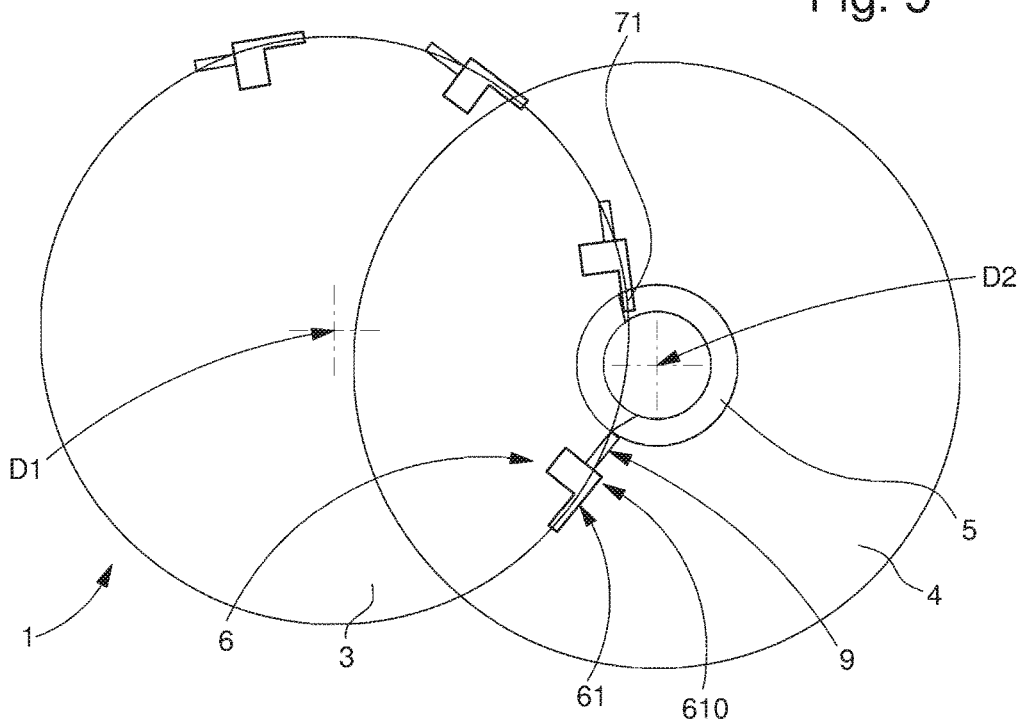
FIGS. 5, 6, 6A and 7 represent a similar mechanism with actuators of a particular shape, each combining a first magnetic surface, a second magnetic surface, and a mechanical stop member.
Figure 6:
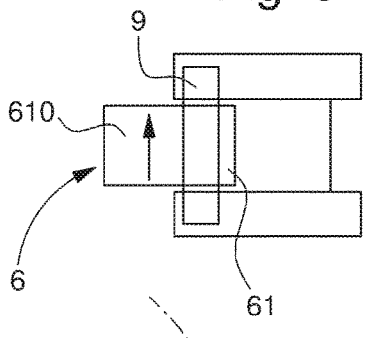
Figure 6A:
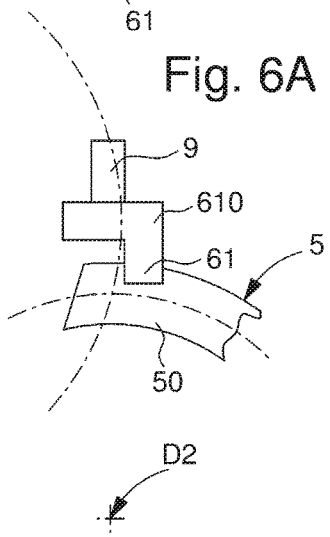
Figure 7:
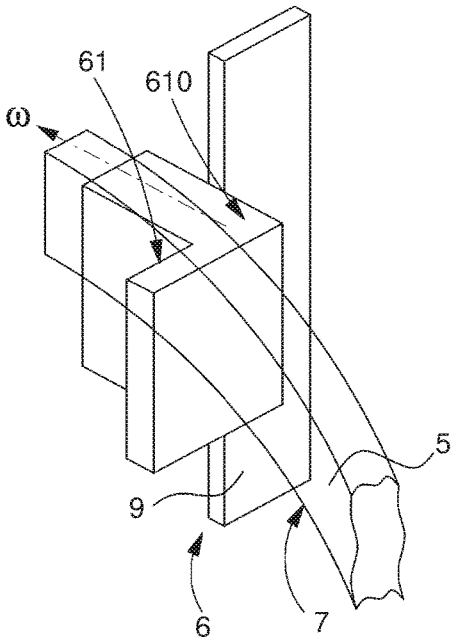
Figure 8:
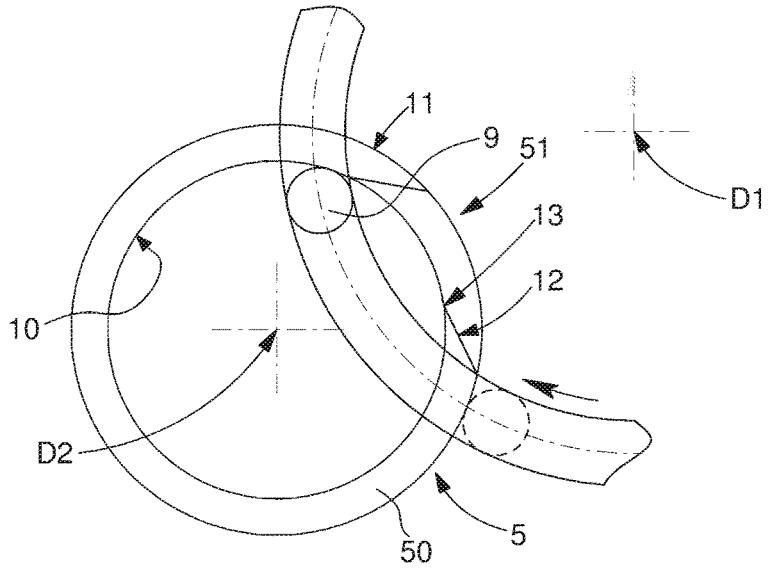
FIGS. 8, 9 and 10 illustrate, in partial plan views, the cooperation, in the event of excessive torque, of the mechanical stop members of the actuators with, depending on the case, the inner or outer cylindrical surface of the ring.
Figure 9:
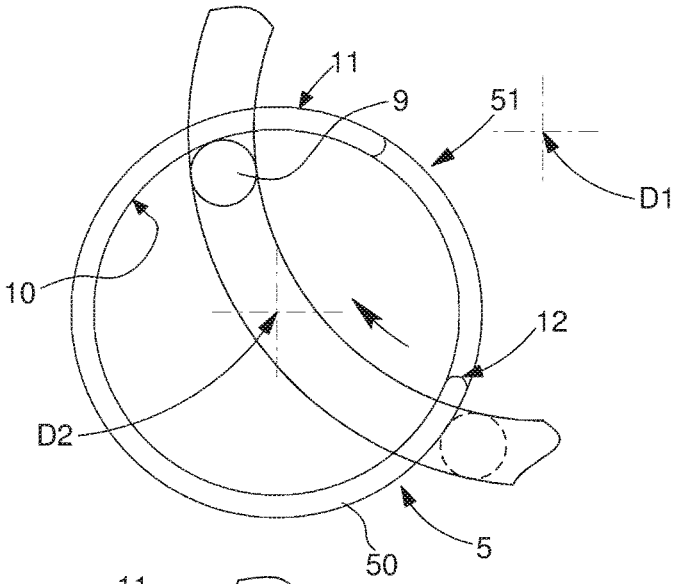
Figure 10:
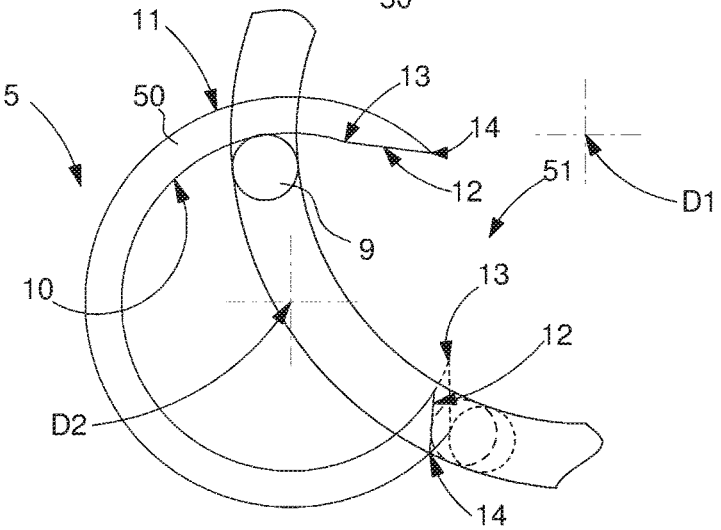

The invention concerns the field of timepiece escapement mechanisms, and more specifically the field of contactless escapement mechanisms.

The invention proposes to adapt the principle of the mechanical cylinder escapement, which has the advantage of ensuring safety in the event of excessive torque, notably following a shock, but whose high friction level significantly impairs the efficiency of the escapement.

To this end, the invention concerns a timepiece escapement mechanism 1, which is arranged to cooperate with means for providing torque, notably drive motor means 2, such as a barrel or similar.

This escapement mechanism 1 includes an escape wheel 3, which is subjected to a rotational torque, having a lower or equal moment to a nominal moment, about a first pivot axis D1, under the action of such means for providing torque.

This escapement mechanism 1 comprises a regulating member or resonator 4 integral with a regulating wheel set 5, preferably mounted to pivot about a second real or virtual pivot axis D2.

Escape wheel 3 includes a plurality of actuators 6, which are regularly spaced on the periphery thereof. Each of these actuators 6 is arranged to cooperate directly with at least a first track 7 comprised in regulating wheel set 5.

According to the invention, each such actuator 6 includes first magnetic or electrostatic stopping means forming a barrier and arranged to cooperate with one such at least first track 7 which is magnetically, or respectively electrically charged, or ferromagnetic, or respectively electrostatically conductive, to exert on first track 7 a torque having a moment greater than the nominal moment.

Each actuator 6 further includes second stopping means arranged to form an end-of-travel stop, arranged to constitute an autonomous escapement mechanism with at least a first complementary stop surface 10 comprised in regulating wheel set 5.

More specifically, the first stopping means comprise a surface 61, 610, 62, 620, which is magnetically, or respectively electrically charged, or ferromagnetic, or respectively electrostatically conductive, forming a barrier, and which is arranged to cooperate with first track 7 which is magnetically, or respectively electrically charged, or ferromagnetic, or respectively electrostatically conductive, so as to create between first track 7 and each surface 61, 610, 62, 620, of the actuator 6 concerned a torque having a moment greater than said nominal moment.

More specifically, these first stopping means include, arranged to cooperate with the first track, on one hand a first surface 61, 62, for exerting a torque with a first moment lower than a second moment of a stopping torque exerted on the other hand by a second surface 610, 620, forming a barrier where there is a magnetic, or respectively electrostatic field, of higher intensity than the magnetic, or respectively electrostatic field present on first surface 61, 62, and second surface 610, 620 being arranged to cooperate with at least a first complementary stop surface 10 comprised in regulating wheel set 5 to constitute therewith an autonomous escapement mechanism.

More specifically, the second stopping means include a mechanical stop member 9, which is arranged to cooperate, in an end-of-travel stop arrangement, with at least a first complementary stop surface 10 comprised in regulating wheel set 5, to constitute therewith an autonomous escapement mechanism.

More specifically, each such actuator 6 includes in succession, in a single direction of entry into cooperation with first track 7, a first said surface 61, 62 a second surface 610, 620, and a mechanical stop member 9.

More specifically, a first magnetically, or respectively electrically charged, or ferromagnetic, or respectively electrostatically conductive surface 61 is arranged to cooperate with one such at least first track 7, which is magnetically, or respectively electrically charged, or ferromagnetic, or respectively electrostatically conductive, so as to repel or attract each first surface 61 of each actuator 6.

Each said actuator 6 includes a mechanical stop member 9, which is arranged to cooperate, in an end-of-travel stop arrangement, with at least a first complementary stop surface 10, and/or with an oblique joining surface 12, comprised in regulating wheel set 5, to constitute with said surface, or with said surfaces, and autonomous escapement mechanism.

Escapement mechanism 1 according to the invention is more specifically a contactless dead-beat escapement. Indeed, the role of the mechanical stop member is to ensure the operation of the escapement mechanism even in the event of application of excessive torque or in the event of a shock: in normal operation, the cooperation of first surfaces 61 with track or tracks 7 of regulating wheel set 5 is sufficient to ensure the operation of the escapement.

Preferably, escape wheel 3 is subjected to a unidirectional rotational torque about a first pivot axis D1 under the action of the torque to which it is subjected, particularly from drive motor means 2.

Preferably, resonator 4 is in reciprocating pivoting motion, and is integral with such a regulating wheel set 5 mounted to pivot about a second pivot axis D2.

Preferably, all the actuators 6 are identical to each other. They preferably have identical radial positioning.

In the particular embodiment illustrated in the Figures, first track 7 is located on a sector of a body of revolution centred on second pivot axis D2 and with an angular amplitude strictly less than 360°. First track 7 may be continuous as in the illustrated case, or be formed of track sections adjacent to each other over at least one part of the periphery of regulating wheel set 5. In a particular embodiment, first magnetically, or respectively electrically charged track 7 is formed of a series of magnetically, or respectively electrically charged studs. In the following description, the term "first track 7" is used for both embodiments.

Preferably, first track 7 is flat, and all the actuators 6 which are arranged to cooperate therewith have first surfaces 61 located in the same plane.

In a particular non-limiting embodiment, and as seen in the Figures, the first complementary stop surface 10 is carried by a truncated ring 50, which is a sector of a body of revolution centred on second pivot axis D2. This first complementary stop surface 10 has an angular amplitude strictly less than 360°, so as to minimise the exchange of energy between resonator 4 and escape wheel 3, except close to the equilibrium position of the resonator.

In a particular embodiment, first track 7 generates a first magnetic, or respectively electrostatic field, which tends to repel each first surface 61 of each actuator 6, said first surface 61 is magnetically, or respectively electrically charged in an opposite polarity to that of the first magnetic, or respectively electrostatic field.

In a particular embodiment, each actuator 6 includes a first magnetically, or respectively electrically charged surface 61, arranged to cooperate with first track 7 which is magnetically, or respectively electrically charged, so as to attract each first surface 61 of each actuator 6. Escape wheel 3 may also comprise a plurality of magnets which interact with a track made of iron or ferromagnetic, or respectively electrostatically conductive material, on a plate integral with resonator 4.

More specifically, this plate is a ring comprising holes disposed to form baffles.

In particular, each said actuator 6 includes a second magnetically, or respectively electrically charged surface 62, arranged to cooperate with a second track 8 of regulating wheel set 5. Preferably, first track 8 is flat, and all the actuators 6 which are arranged to cooperate therewith have second surfaces 62 located in the same plane. More specifically, said second track 8 is parallel to said first track 7, and perpendicular to second pivot axis D2.

Like first track 7, second track 8 is an annular sector centred on second pivot axis D2 and with an angular amplitude strictly less than 360°, and it generates a second magnetic, or respectively electrostatic field, which tends to repel each second surface 62; said second surface 62 is magnetically, or respectively electrically charged with an opposite polarity to that of said second magnetic, or respectively electrostatic field. In a particular embodiment, second magnetically, or respectively electrically charged track 8 is formed of a series of magnetically, or respectively electrically charged studs.

Figure 12:
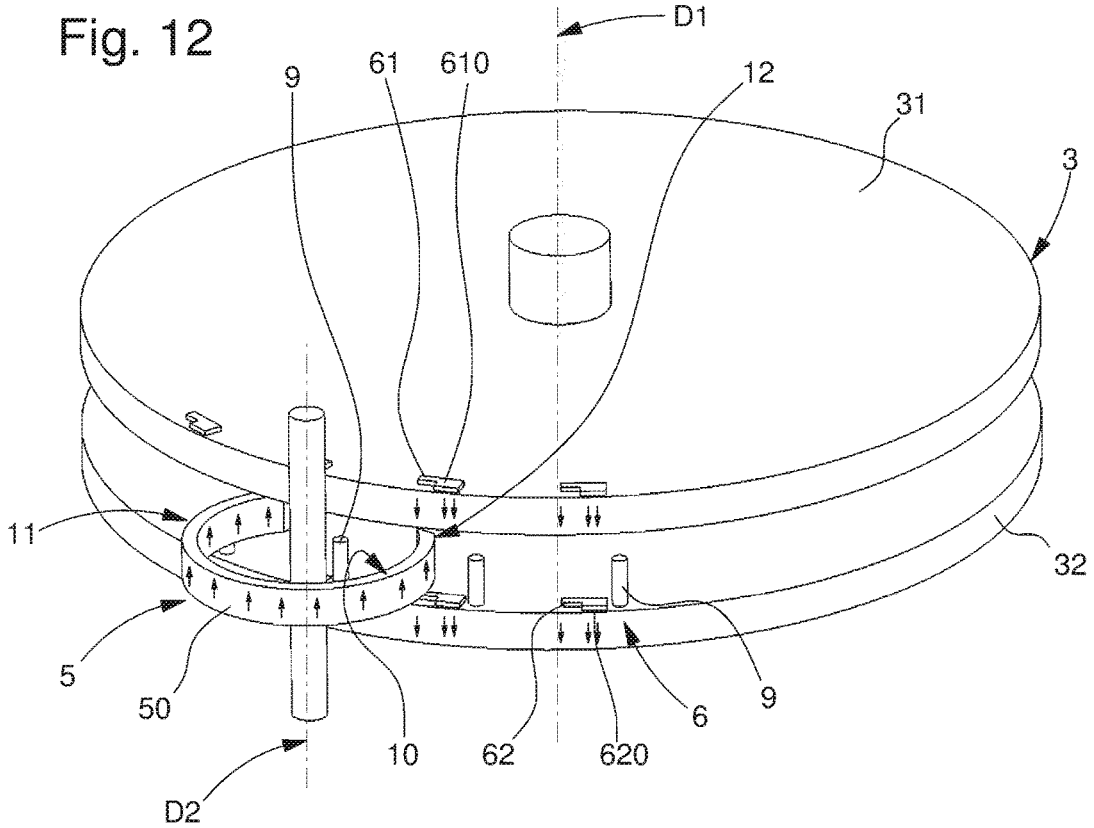
Figure 13:
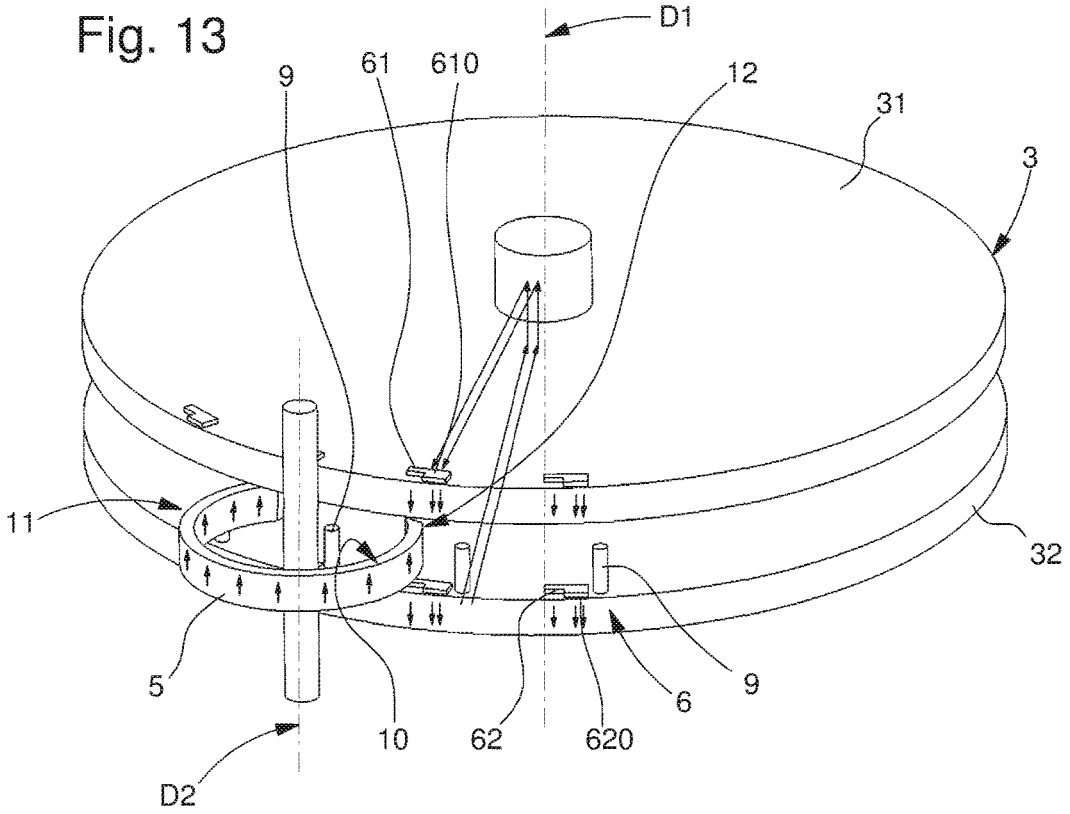

Advantageously, as seen in FIGS. 12 and 13, escape wheel 3 includes at least one upper disc 31 comprising first surfaces 61, and a lower disc 32 comprising second surfaces 62 located perpendicular to and facing said first surfaces 61, and escape wheel 3 comprises magnetic, or respectively electrostatic field closing means, between upper disc 31 and lower disc 32. This arrangement avoids excessive axial force on the escape wheel. Preferably, the forces exerted on both sides of regulating wheel set 5 are equal.

According to a particular feature of the invention, each mechanical stop member 9 is also arranged to cooperate, in an end-of-travel stop arrangement, with at least a second complementary stop surface 11 comprised in regulating wheel set 5. This second complementary stop surface 11 is more particularly carried by a surface of revolution centred on second pivot axis D2, and has an angular amplitude strictly less than 360°.

Preferably, second complementary stop surface 11 is connected to first complementary stop surface 10 by at least one joining surface 12, which is arranged to form an impulse ramp for resonator 4 when joining surface 12 abuts on an actuator 6, arranged to provide energy to the resonator close to its equilibrium position. In a preferred non-limiting embodiment, illustrated by the Figures, joining surface 12 is flat or substantially flat, parallel to second pivot axis D2, and tilted with respect to the radial plane joining it to second pivot axis D2 and passing therethrough.

In a particular embodiment, mechanical stop member 9 includes, in a similar manner, an impulse ramp arranged to provide energy to the resonator close to its equilibrium position.

Preferably, such an impulse ramp only provides energy to the resonator close to its equilibrium position if the drive torque imparted to escape wheel 3 is such that the repulsion, or respectively attraction, between first track 7 and each first surface 61, is insufficient to prevent contact between mechanical stop member 9 and regulating wheel set 5.

In a particular embodiment, first magnetically, or respectively electrically charged track 7 is formed of a series of magnetically, or respectively electrically charged studs.

In a particular embodiment, each first magnetically, or respectively electrically charged surface 61 comprises a section that gradually decreases in the radial direction away from first pivot axis D1, so that the area of a superposition surface 71 corresponding to the projection of first surface 61 onto first track 7 is variable during the relative pivoting of escape wheel 3 and regulating wheel set 5.

Preferably, escape wheel 3 gradually provides energy to regulating wheel set 5, and regulating wheel set 5 returns all this accumulated energy instantaneously, in the form of an impulse imparted to resonator 4, escapement mechanism 1 thus forming a constant force escapement mechanism.

In an embodiment illustrated by the Figures, escapement mechanism 1 according to the invention constitutes a cylinder escapement mechanism, wherein first complementary stop surface 10 is the inner surface of a cylindrical tubular sector, and wherein the second complementary stop surface 11 is the outer surface of this cylindrical tubular sector.

In an alternative embodiment, escapement mechanism 1 according to the invention constitutes a pin wheel escapement mechanism of the Lepaute type, wherein escape wheel 3 includes a half pin on each actuator 6, and wherein first complementary stop surface 10 is the inner surface of a first drawing compass link member, and wherein second complementary stop surface 11 is the outer surface of the second drawing compass link member. The inner surface of the first link member and the outer surface of said second link member are separated by a space whose width is greater than the radius of the half pin. In a first alternative, the first drawing compass link member and the second drawing compass link member are integral with each other. In a second alternative, the first drawing compass link member and the second drawing compass link member pivot about a common axis, and are connected to each other by a spring or suchlike. This pin wheel escapement is most suited to static timepieces, the elimination of friction resulting from the implementation of magnetic or electrostatic fields provides precise and silent operation, which allows the use thereof for wall or table clocks.

In a very specific embodiment, described in more particular detail below with reference to FIGS. 12 to 31, each actuator 6 includes, between first surface 61 (or respectively second surface 62) and mechanical stop member 9, a barrier 610 (respectively 620) that is magnetically charged or respectively electrically charged, where there is a magnetic, or respectively electrostatic field of greater intensity than the magnetic, respectively electrostatic field present on first surface 61 (or respectively second surface 62).

The escapement is thus improved and constitutes a constant force system. Combining several magnetic, or respectively electrostatic poles, which follow one another in the travel of escape wheel 3 with respect to regulating wheel set 5 makes it possible to recharge a magnetic, or respectively electrostatic repulsion potential (between the poles and regulating wheel set 5), which is released on the passage of the balance roller notch. Escape wheel 3 then has sufficient torque to superpose first surface 61 (or respectively second surface 62) on first track 7 (or respectively second track 8), but not sufficient to superpose thereon barrier 610 (respectively 620) which stops the wheel.

The transmitted energy thus corresponds to this magnetic or electrostatic repulsion potential between, on the one hand, first surface 61 (or respectively second surface 62), and on the other hand, first track 7 (or respectively second track 8), which is a constant potential, which provides a constant force or torque which will be referred to more generally as a "constant force".

It is to be noted that the geometry of the escapement may be substantially different from the conventional cylinder escapement. For example:

the diameter of the cylinder may be greater;

the cylinder may comprise a number of teeth greater than one;

an impulse is not necessarily imparted on each vibration;

the arbor is not necessarily hollow, a plate can fulfil the function of the cylinder;

the system may operate at small amplitudes.

The invention thus avoids certain geometric constraints of the conventional cylinder escapement.

An additional advantage lies in the fact that, most of the time, the pivots are pressed onto jewels, which results in a smaller difference in rate between the horizontal and vertical position of the watch than in a conventional cylinder escapement.

The magnetic or electrostatic repulsion can be achieved in various manners. One possibility is to form, as seen in the Figures, a two-level escape wheel which sandwiches the balance roller. The escape wheel may be made of iron or ferromagnetic, or respectively electrostatically conductive material, in order to form a magnetic, respectively electrostatic track. An architecture with a two-level roller and a single-level wheel is also possible.

Escapement mechanism 1 according to the invention is, notably, devoid of a stop element such as a pallet lever or suchlike.

The invention also concerns a timepiece movement 100 comprising at least one such escapement mechanism 1 and comprising drive motor means 2 subjecting an escape wheel 3 to a unidirectional rotational torque about a first pivot axis D1. According to the invention, drive motor means 2 are arranged to deliver sufficient torque to allow the complete superposition of each first surface 61 with first track 7.

In the advantageous version where actuators 6 comprise barriers, the maximum torque delivered by drive motor means 2 is limited to a level that is insufficient to allow the complete superposition of each barrier 610 with first track 7.

The invention also concerns a timepiece, particularly a watch, including at least one such movement 100.

Figure 11:
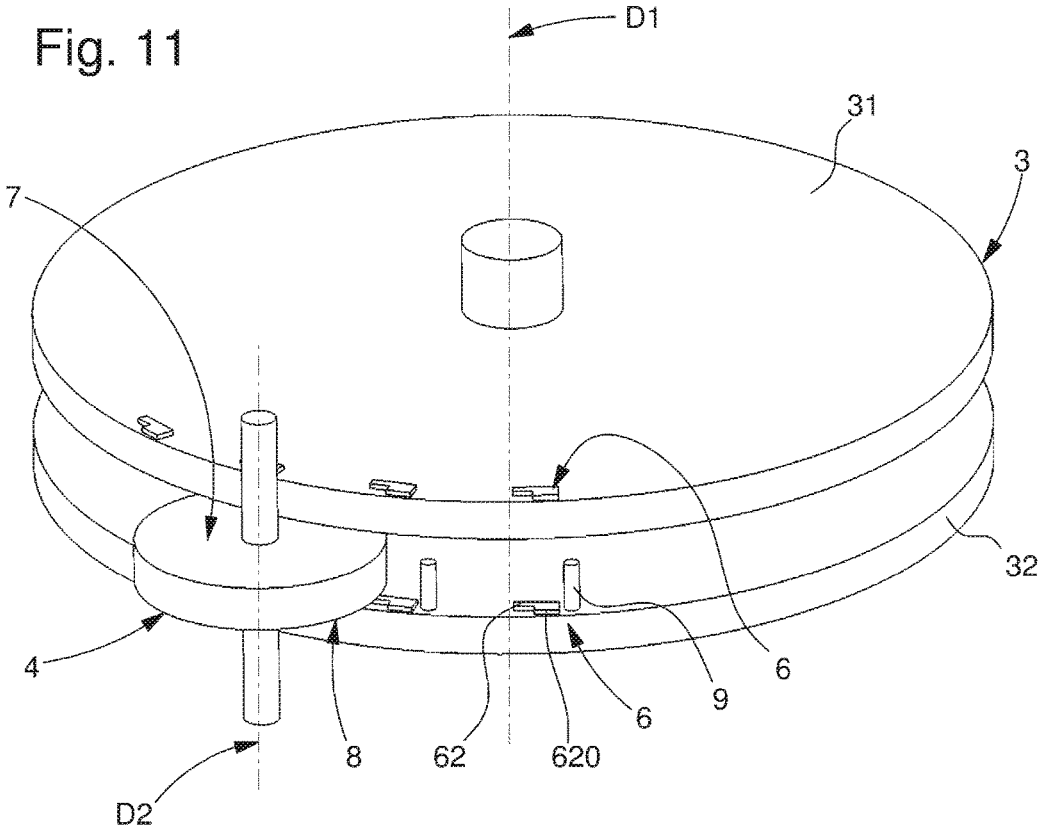
FIGS. 11 to 13 illustrate an example embodiment of an escapement mechanism according to the invention, in a magnetic alternative: In this non-limiting example, an escape wheel includes two discs (upper and lower), each equipped with magnetized actuators in an axial direction. This escape wheel cooperates with a balance having a roller, not illustrated in FIGS. 12 and 13, which show only a regulating wheel set carried by the roller, and which includes a truncated cylindrical ring, magnetized in an axial direction.

FIGS. 11 to 13 illustrate an example embodiment of an escapement mechanism according to the invention, in a magnetic alternative, and wherein escape wheel 3, pivot axis D1, comprises 2 discs—upper disc 31 and lower disc 32—each equipped with actuators 6 which are magnetized here in an axial direction parallel to D1, with first surfaces 61 on upper disc 31, second surfaces 62 on lower disc 32, first barriers 610 on upper disc 31, second barriers 620 on lower disc 32, and, on both discs, mechanical stop members 9. Escape wheel 3 cooperates with a balance 4 having a roller, the latter is not represented in FIGS. 12 and 13 which show only regulating wheel set 5 which is carried by the roller, and which includes a preferably truncated cylindrical ring 50, of pivot axis D2, which is parallel to D1 here. Ring 50 is magnetized in an axial direction parallel to D2.

Ring 50 includes a complementary inner stop surface 10, and a second complementary outer stop surface 11, connected on each side of an opening 51 by a preferably sloping joining surface 12, and delimited on the inner side by an inner beak 13, and on the outer side by an outer beak 14.

In a preferred but non-limiting embodiment, as seen in the Figures, the configuration of sloping surfaces 12 and of beaks 13 and 14 is not symmetrical, on both sides of opening 51. Preferably, the two sloping surfaces 12 are flat, and tilted, and each form an angle of the same orientation and substantially the same value, with a radial line derived from pivot axis D2.

FIG. 12 shows the respective magnetizations of regulating wheel set 5 and of actuators 6. The torque from escape wheel 3 forces a first magnetized portion, in this case first surface 61 or respectively second surface 62, of actuator 6, arriving near ring 50, to be superposed on, or respectively under, magnetized ring 50. The second magnetized portion to appear in the area of interference, and which is formed by first barrier 610, respectively second barrier 620, exhibits too much magnetic repulsion with ring 50, which has the effect of stopping escape wheel 3. Mechanical stop members 9 prevent a loss of synchronization of the system in the event of shock or excessive torque on escape wheel 3.

As illustrated in FIG. 13, the embodiment of escape wheel 3 in two parts 31, 32, allows the magnetic track to be closed, and avoids excessive axial force on the roller.

Figure 14:
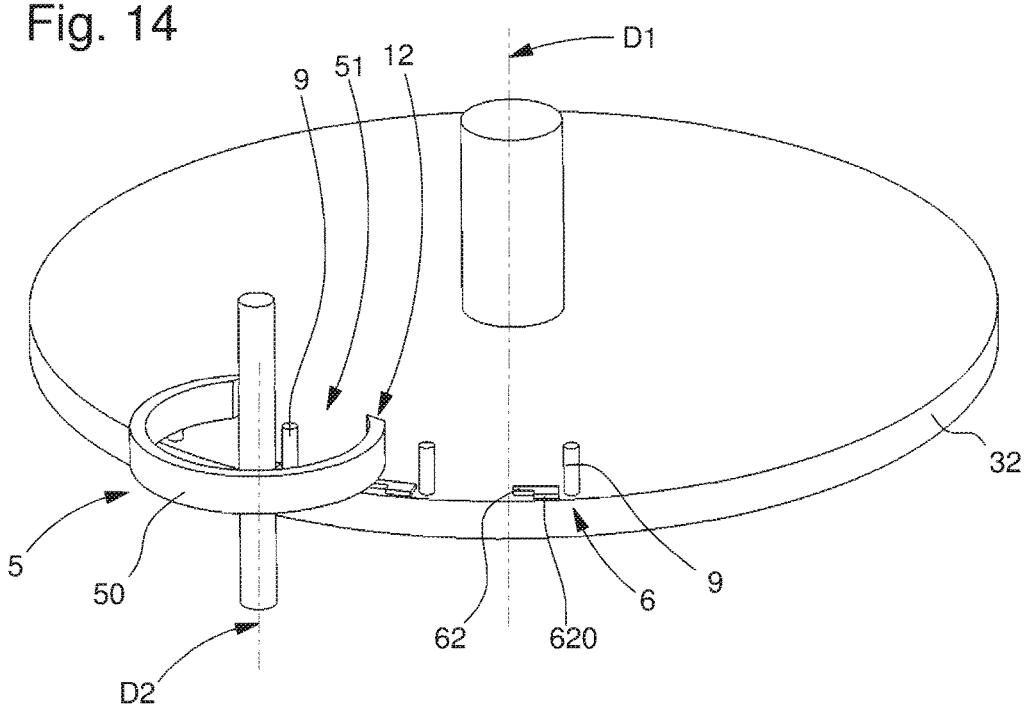
FIG. 14 represents the mechanism of FIGS. 11 to 13; the upper disc is not represented, in order to illustrate the position of the actuators, notably in the area of interaction with the ring.

FIG. 14 represents the same assembly; upper disc 31 is not represented, in order to illustrate the position of actuators 6, notably in the area of interference with ring 50.

Figure 15:
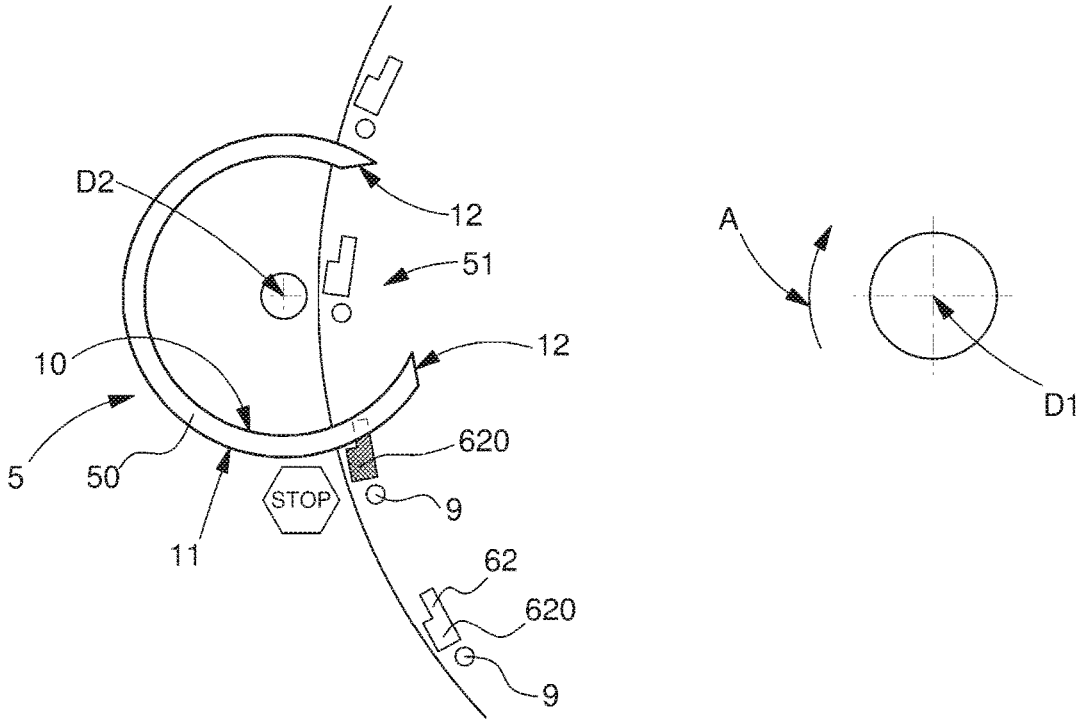
FIGS. 15 to 35 are top views of the partial exploded view of FIG. 14, and illustrate the kinematics of the escapement mechanism according to the invention.

FIGS. 15 to 35 are top views of this partial exploded view of FIG. 14, and illustrate the kinematics of the system, from FIG. 15, which illustrates the end of a cycle where escape wheel 3 rotates in the clockwise direction A, under the effect of drive means 2, which are not illustrated, such as a barrel via a gear train. The balance also rotates in the clockwise direction under the return action of the balance spring. An actuator 6 reaches interference with the exterior of ring 50, on second complementary outer stop surface 11. The torque from escape wheel 3 forces second surface 62 to be superposed under magnetized ring 50. Second barrier 620 exhibits too much magnetic repulsion with ring 50, which has the effect of stopping escape wheel 3, with the actuator 6 concerned outside ring 50.

Figure 16:
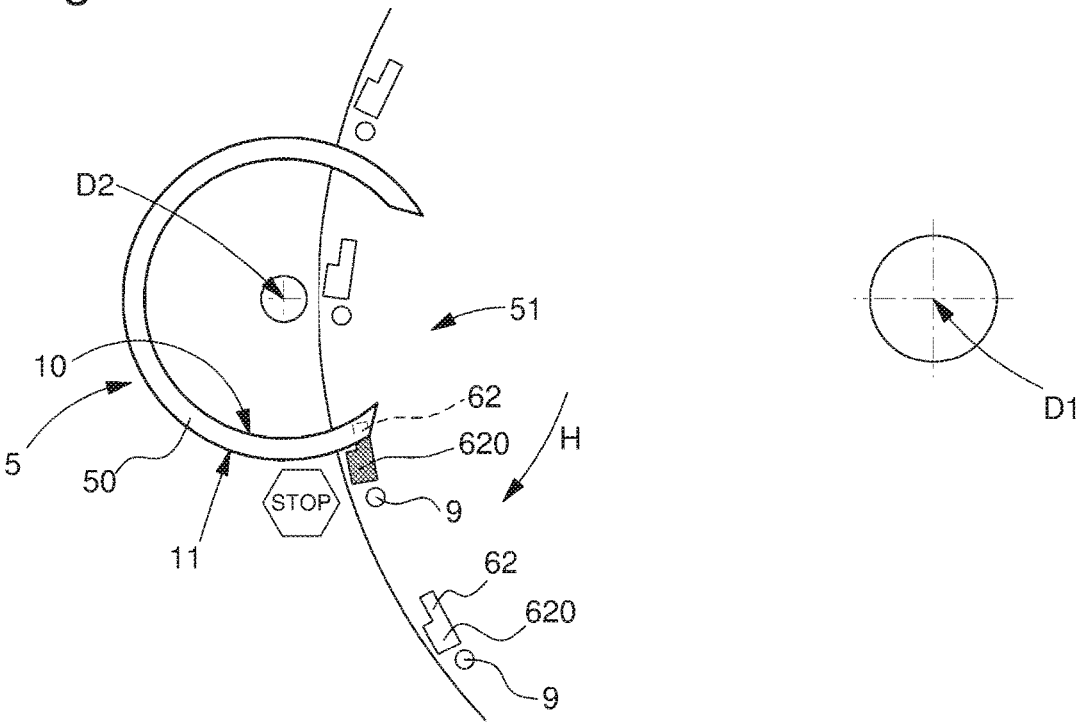

FIG. 16 shows the continued travel of the balance in the clockwise direction, which passes through the dead point where the return torque of the balance spring is zero, and second surface 62 starts to apply a time impulse to the balance by magnetic repulsion, in a similar manner to a constant force.

The following Figures include arrows illustrating the rotations already made by the balance and the escape wheel after this stage.

Figure 17:
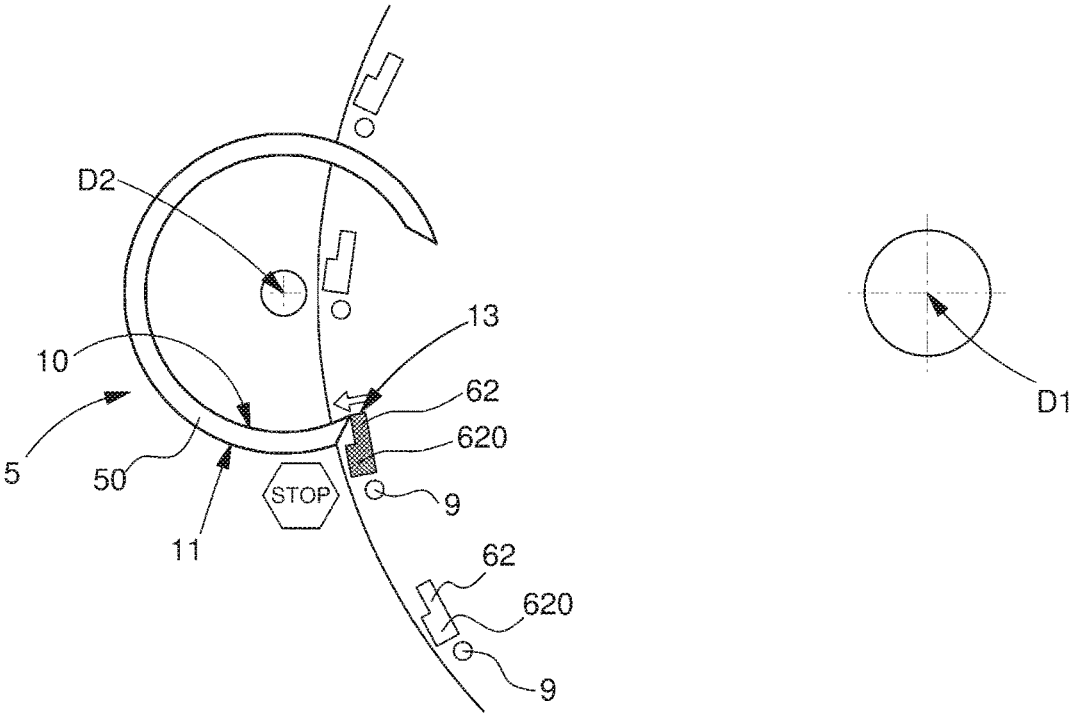

FIG. 17 shows the end of the time impulse, second surface 62 crosses joining surface 12, and avoids inner beak 13 which delimits said joining surface. Through its clockwise rotation, the balance releases second surface 62 of actuator 6, and does not resist the passage of its second barrier 620 or of stop member 9. Escape wheel 3 can then start to rotate in the clockwise direction.

Figure 18:
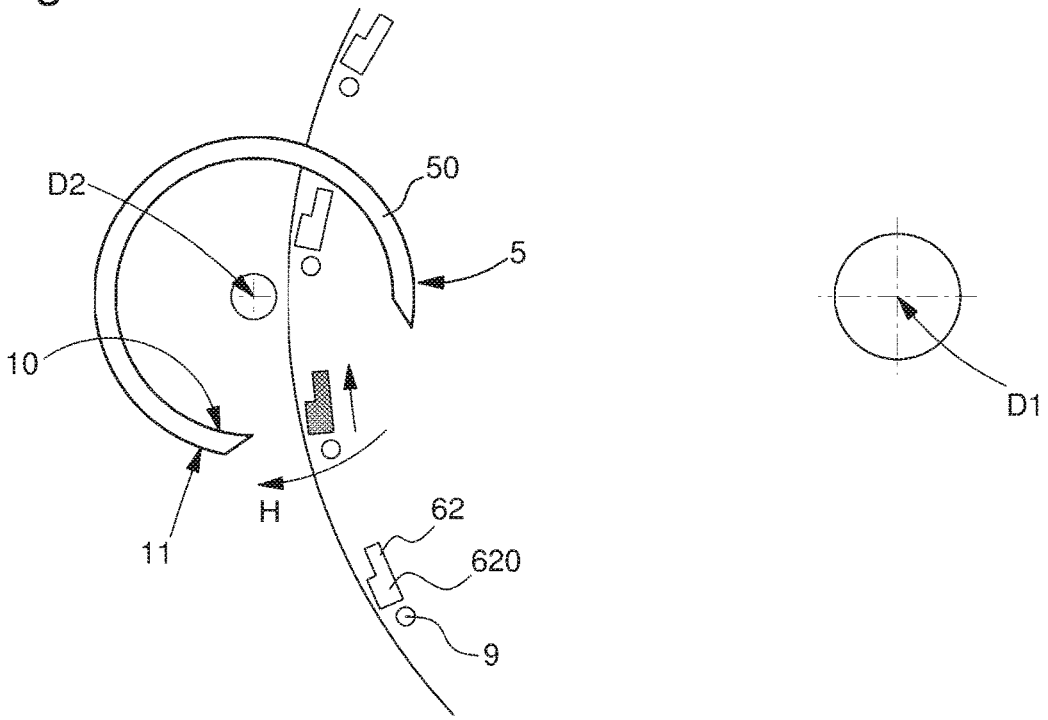

FIG. 18 shows the system at the start of the vibration of the balance, which rotates under the effect of the impulse in clockwise direction H, and the rotation of escape wheel 3. Actuator 6 enters the area at the footprint of ring 50, inside said ring.

Figure 19:
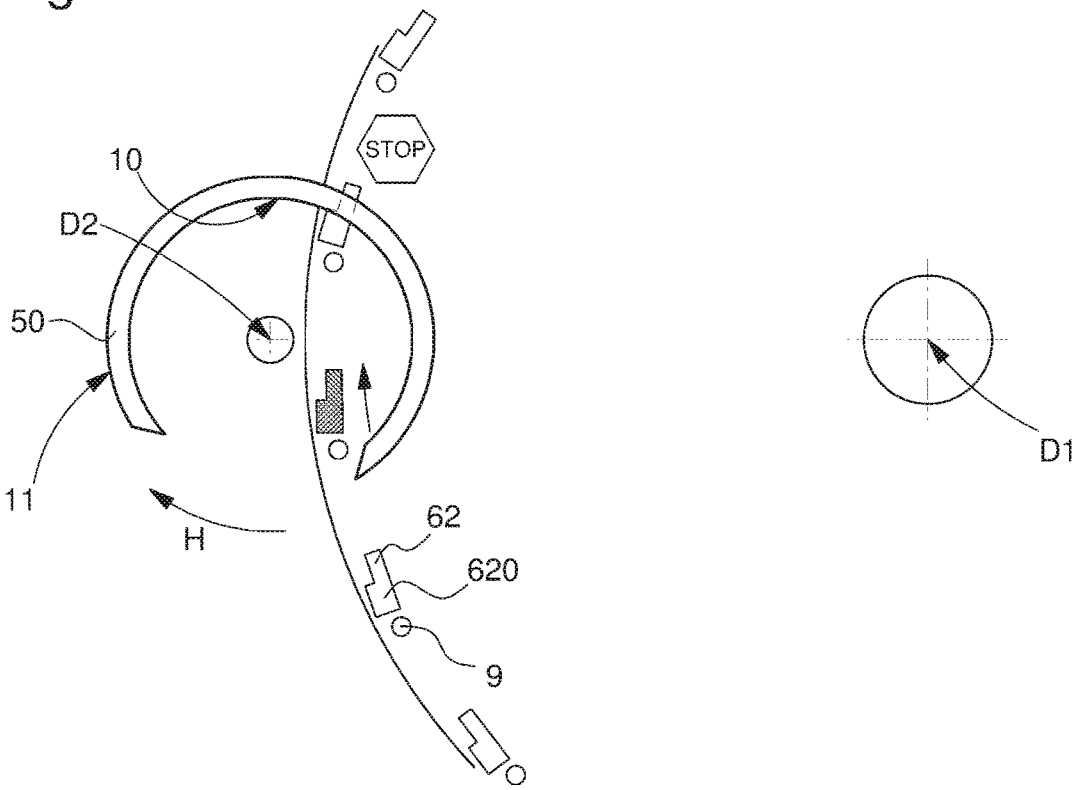

FIG. 19 shows an actuator 6 reaching interference with the interior of ring 50, on a first complementary inner stop surface 10, with the balance still rotating in clockwise direction H under the effect of the impulse. The torque from escape wheel 3 forces second surface 62 to be superposed under magnetized ring 50. Second barrier 620 exhibits too much magnetic repulsion with ring 50, which has the effect of stopping escape wheel 3, with the actuator 6 concerned inside ring 50.

Figure 20:
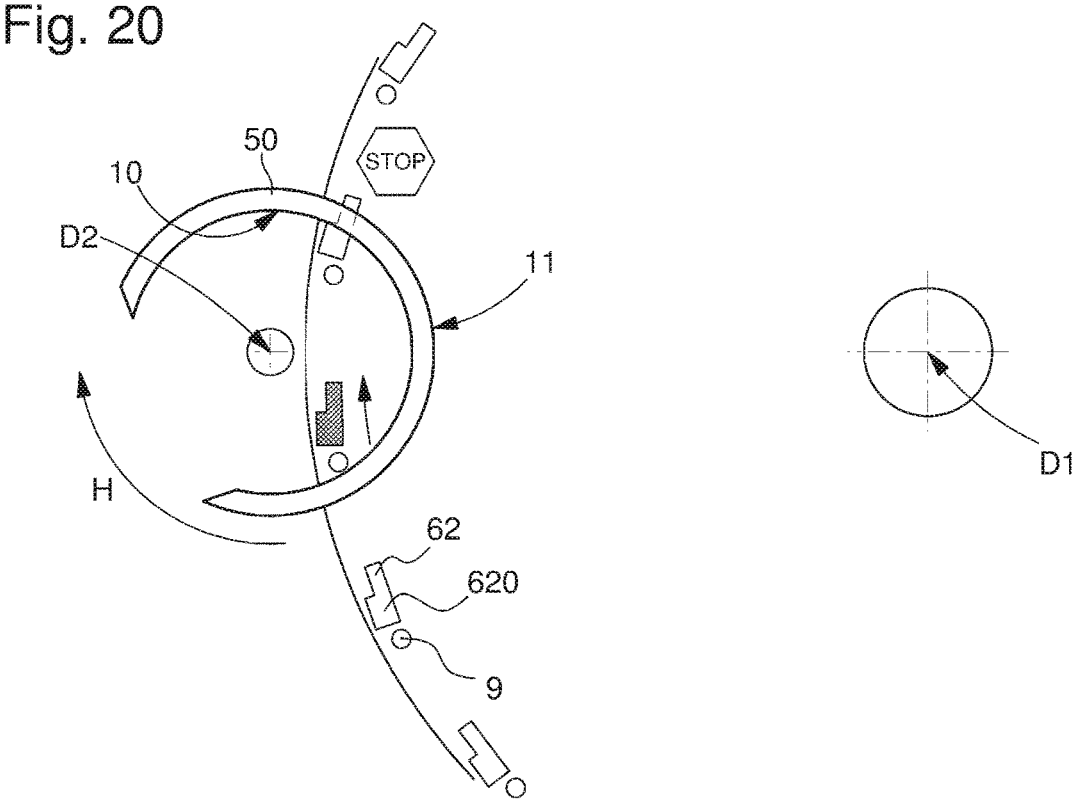

The balance continues its rotation in clockwise direction H, until maximum amplitude, with escape wheel 3 still stopped, as seen in FIG. 20.

Figure 21:
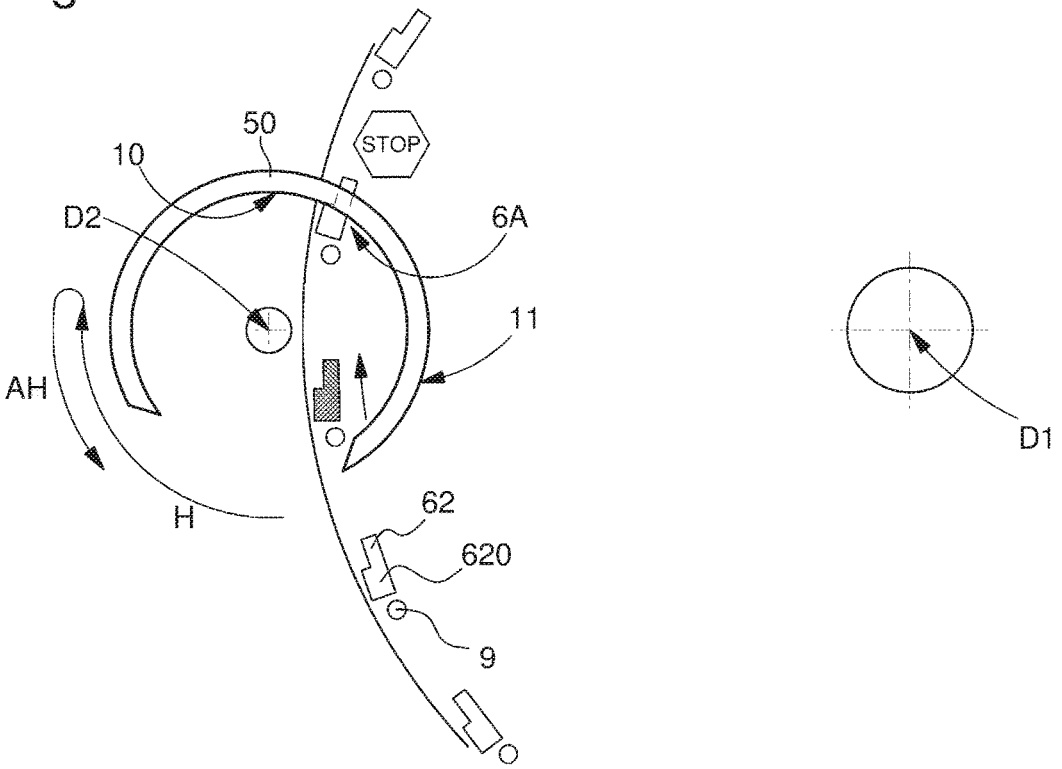
Figure 22:
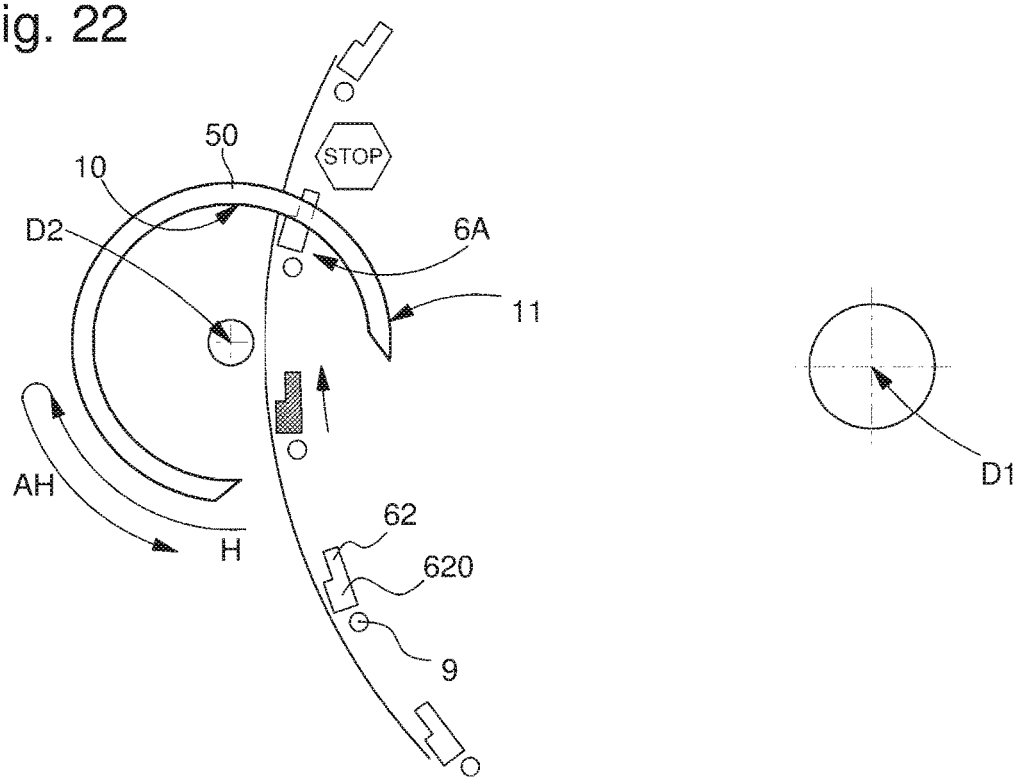

The balance then changes to rotation in anticlockwise direction AH, with escape wheel 3 still stopped, as seen in FIGS. 21 and 22, in which an inner beak 13 of ring 50 approaches actuators 6 of escape wheel 3.

Figure 23:
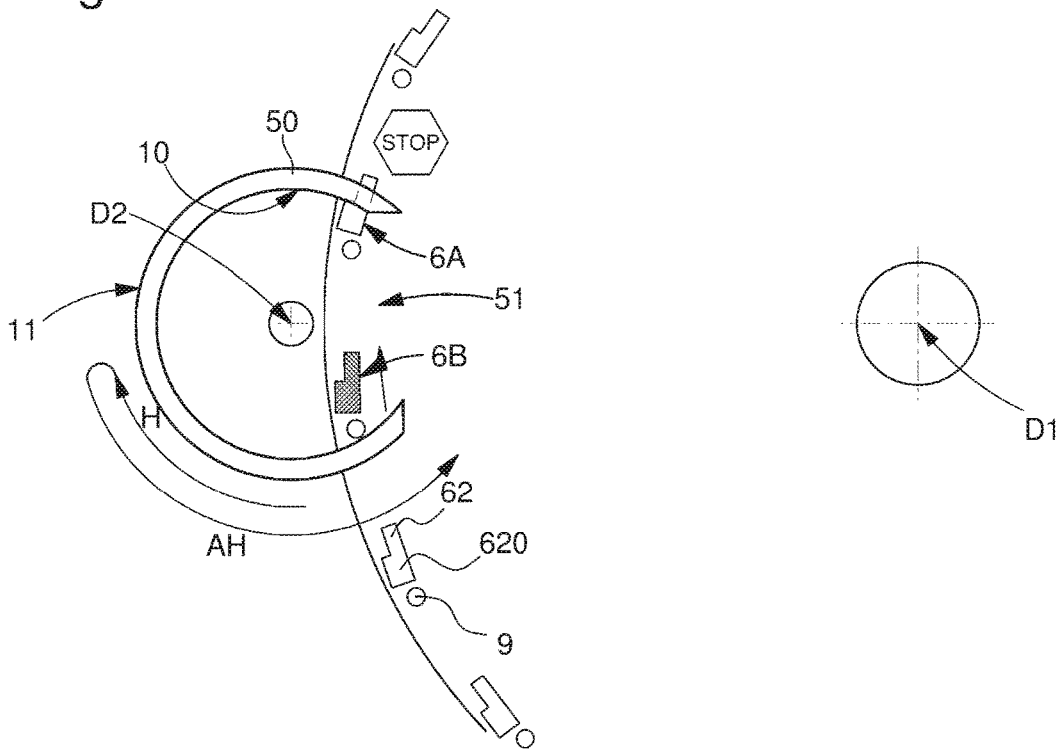

In FIG. 23, the balance is still rotating in anticlockwise direction AH, ring 50 passes behind a second actuator 6B which is kept at a standstill, behind actuator 6A which is in a blocking position on first complementary inner stop surface 10 and which is waiting to be released, which will allow the impulse to be applied to the balance, this time in the anticlockwise direction. In this particular embodiment, at least two actuators 6: 6A, 6B, can thus remain within the inner volume of ring 50.

Figure 24:
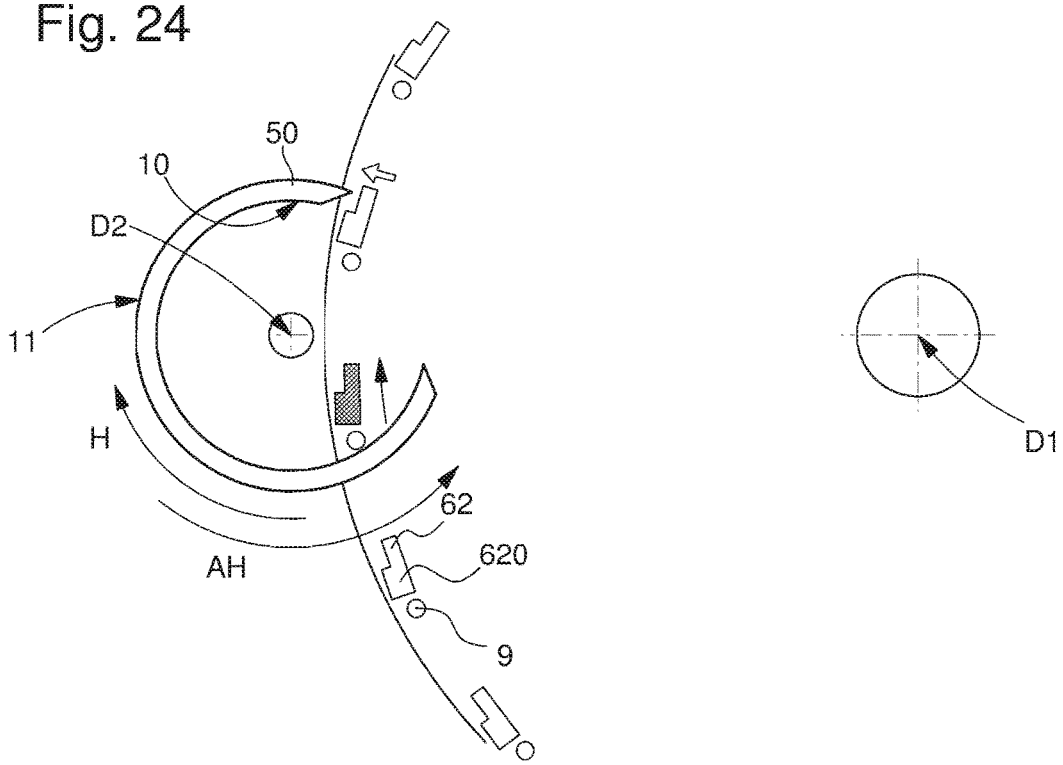

FIG. 24 shows, like FIG. 17, the end of the time impulse; second surface 62 crosses joining surface 12 and avoids inner beak 13 which delimits said joining surface. Through its anticlockwise rotation, the balance releases second surface 62 of actuator 6, and does not resist the passage of its second barrier 620 or of stop member 9. Escape wheel 3 can then start to rotate in the clockwise direction.

Figure 25:
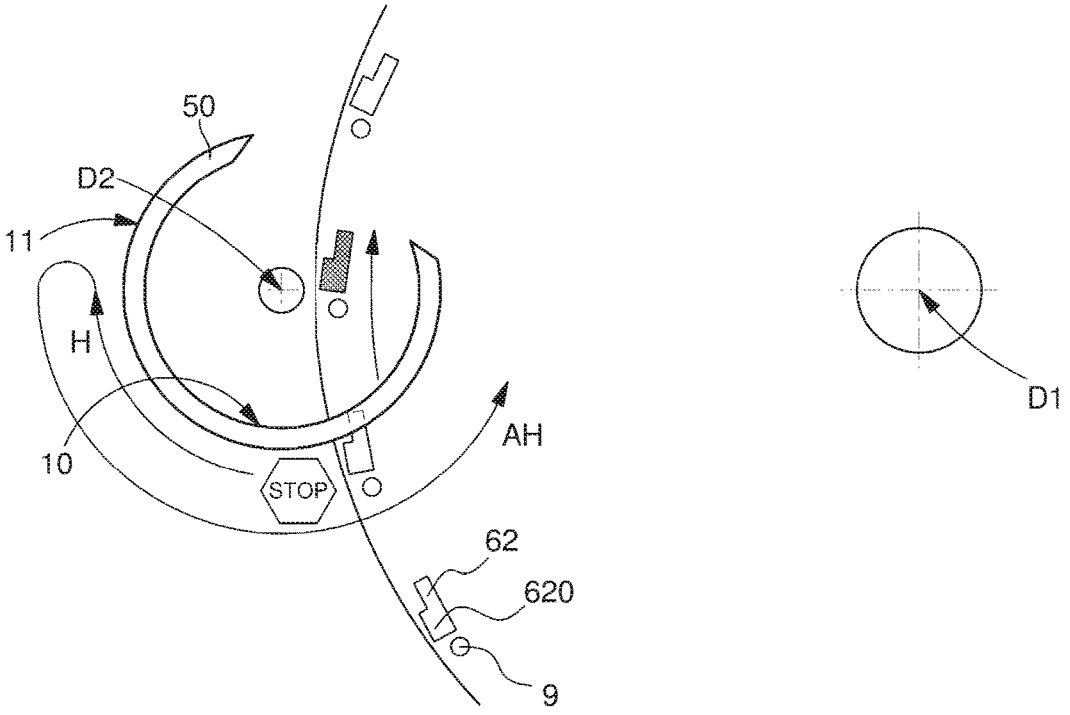

FIG. 25 shows an actuator 6 drawing alongside second complementary outer stop surface 11 of ring 50, and, as before, the stopping of escape wheel 3.

Figure 26:
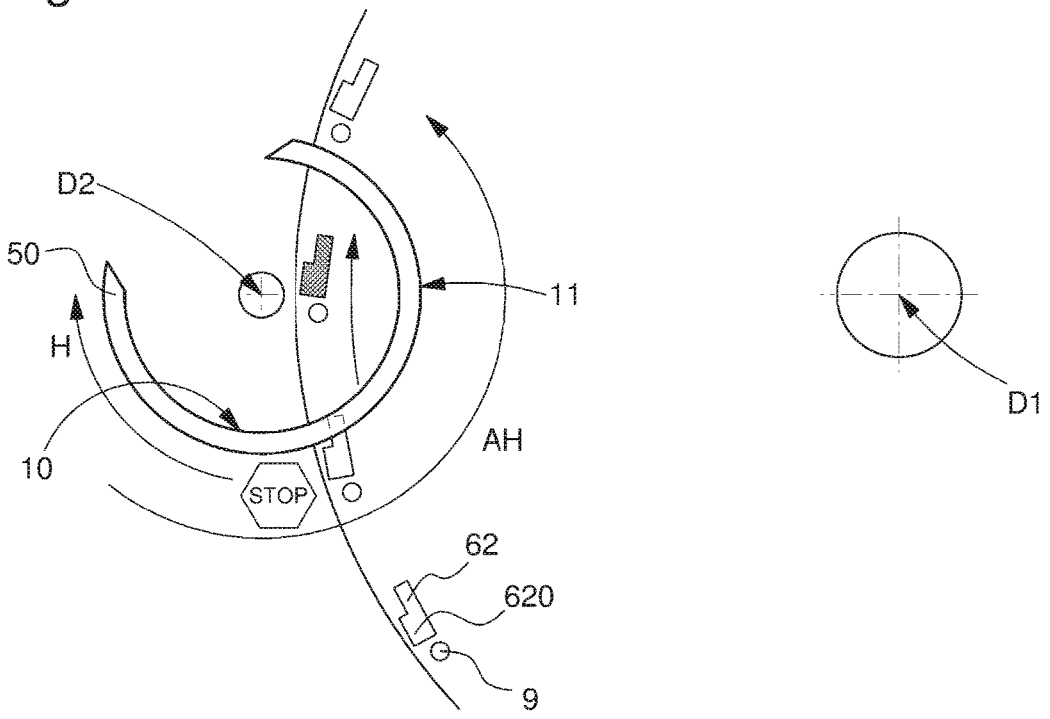

FIG. 26 illustrates the end of the anticlockwise rotation AH of the balance, with escape wheel 3 still stopped.

Figure 27:
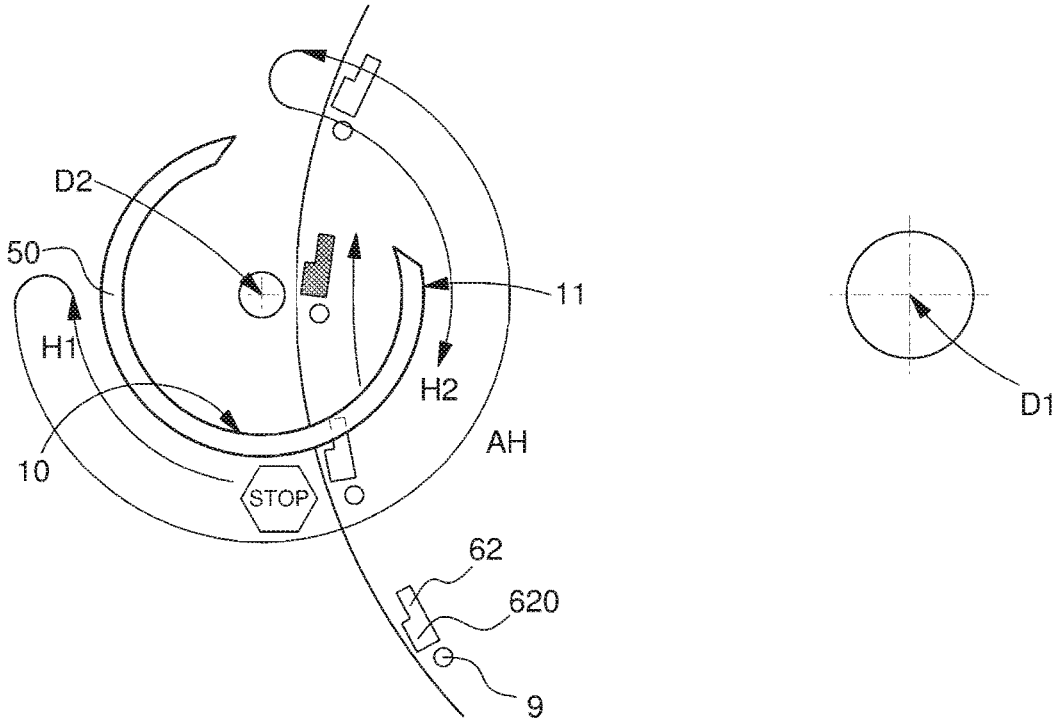
Figure 28:
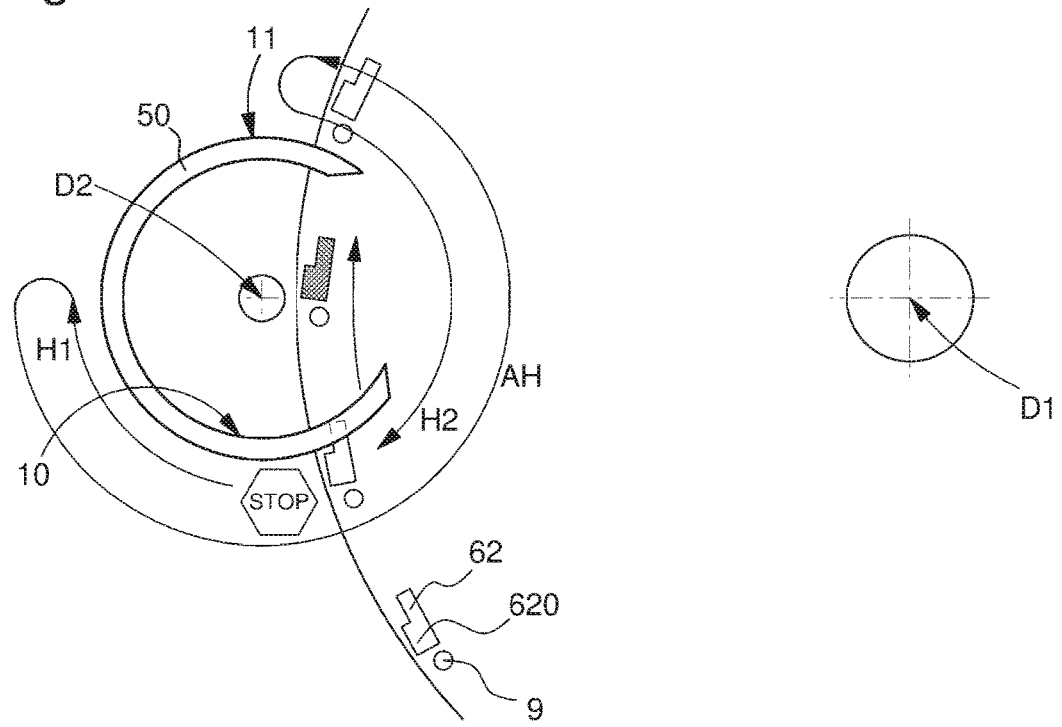
Figure 29:
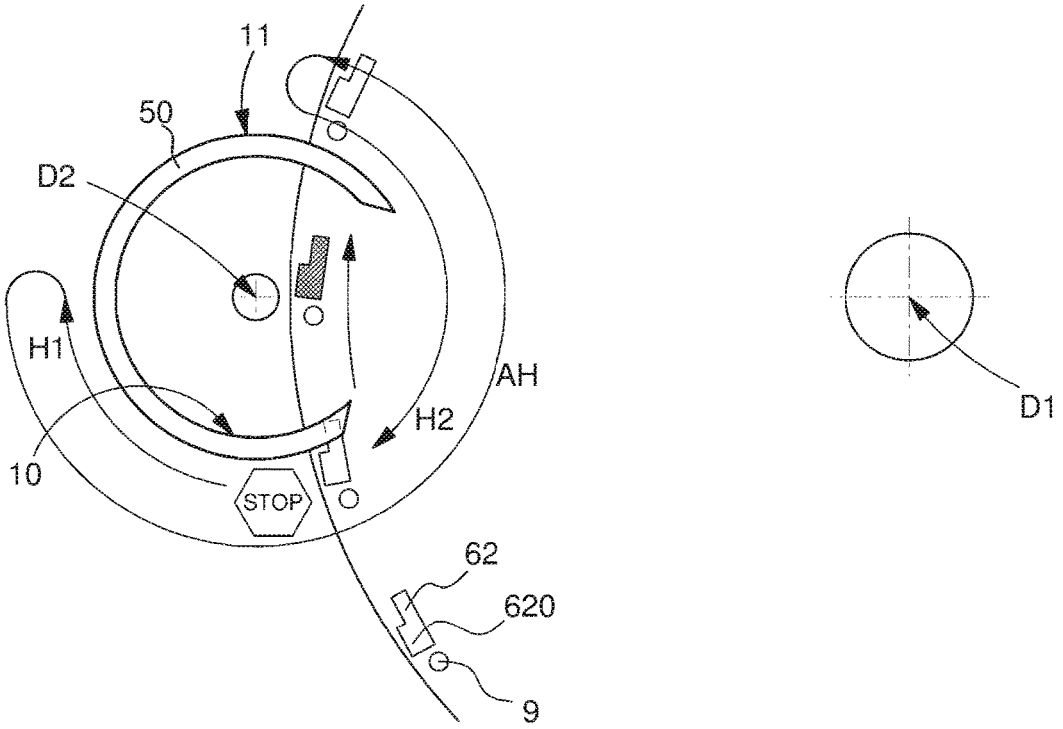

FIG. 27 shows the balance changing to clockwise direction H2, with escape wheel 3 still stopped. In FIG. 28, the balance continues its time rotation. FIG. 29 shows the start of the time impulse, with escape wheel 3 still stopped. The amplitude of the two vibrations is substantially symmetrical. It is to be noted that, in the example illustrated by the Figures, the impulses are not given for exactly the same angular position of the roller, an optimised escapement route, within the grasp of a timepiece escapement designer, can improve this situation.

The mechanism according to the invention is devised to address the case of excessive torque.

Figure 30:
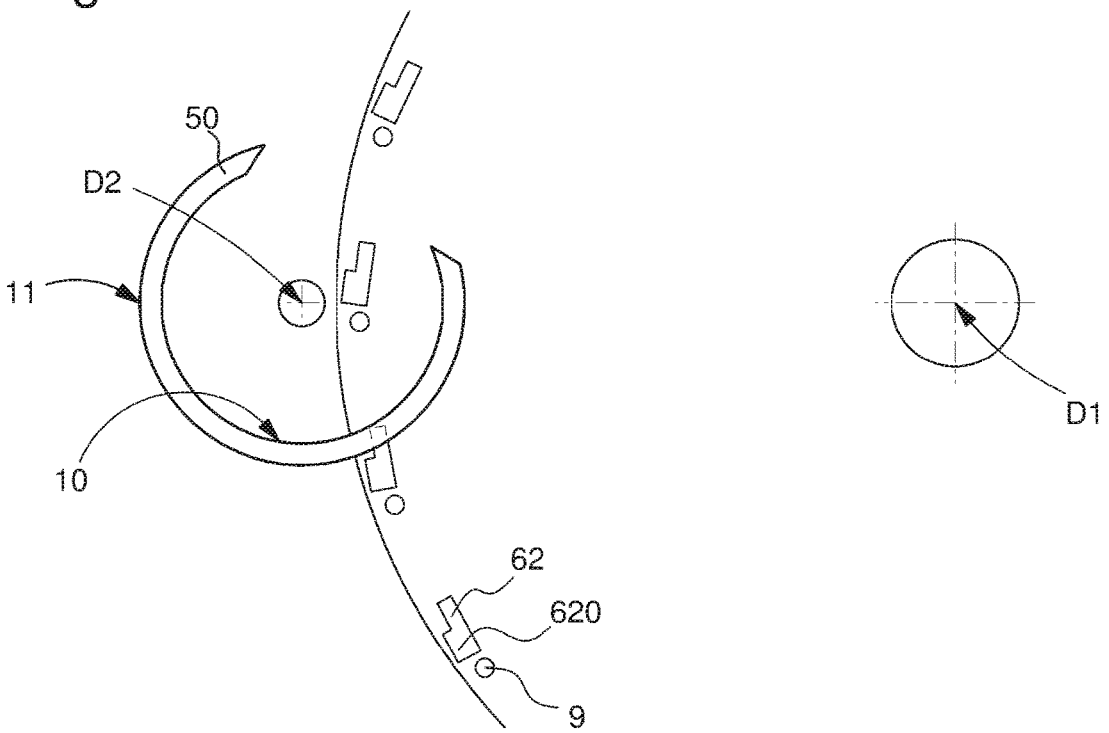
Figure 31:
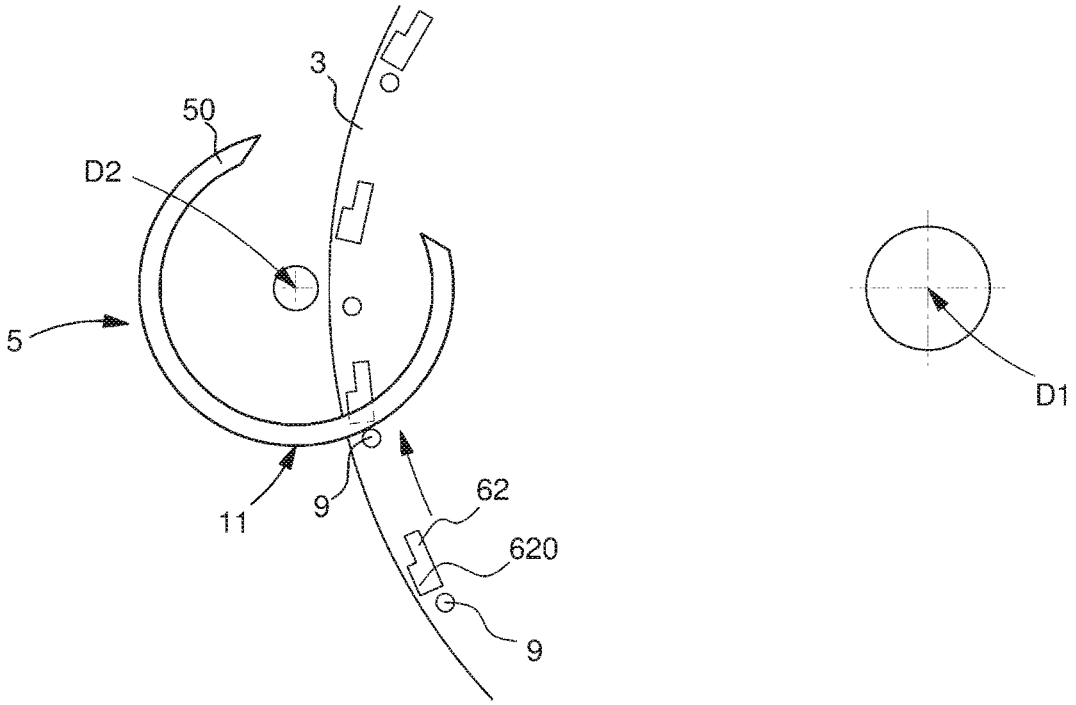

FIG. 30 illustrates a system for a nominal torque at the escape wheel.

Figure 32:
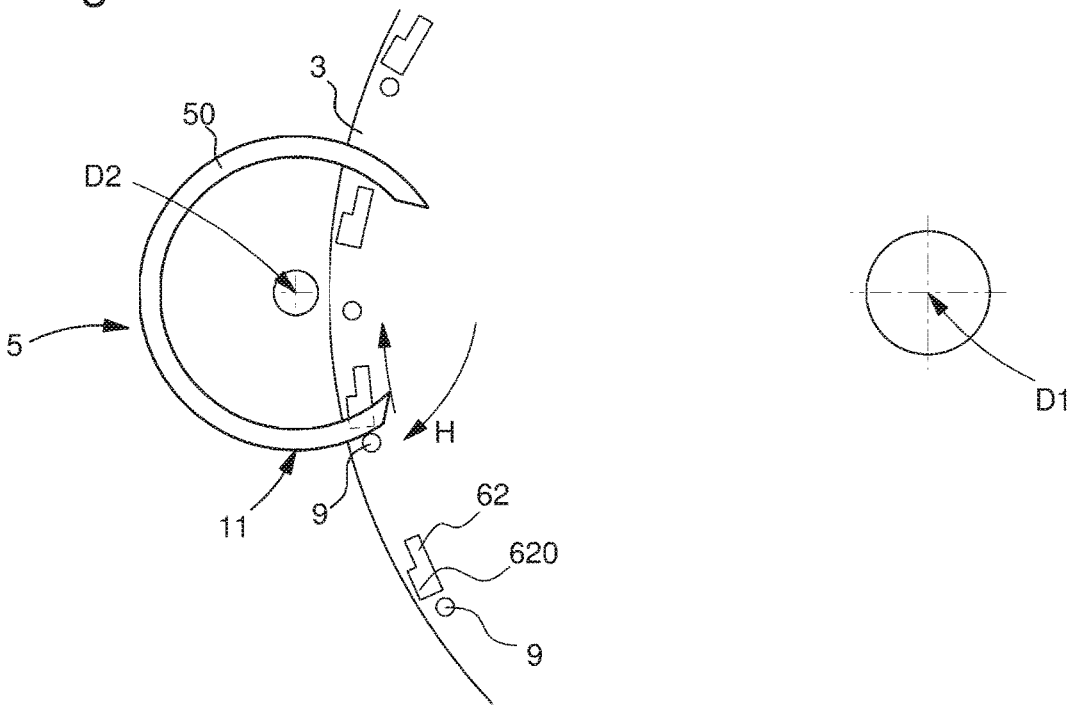
Figure 33:
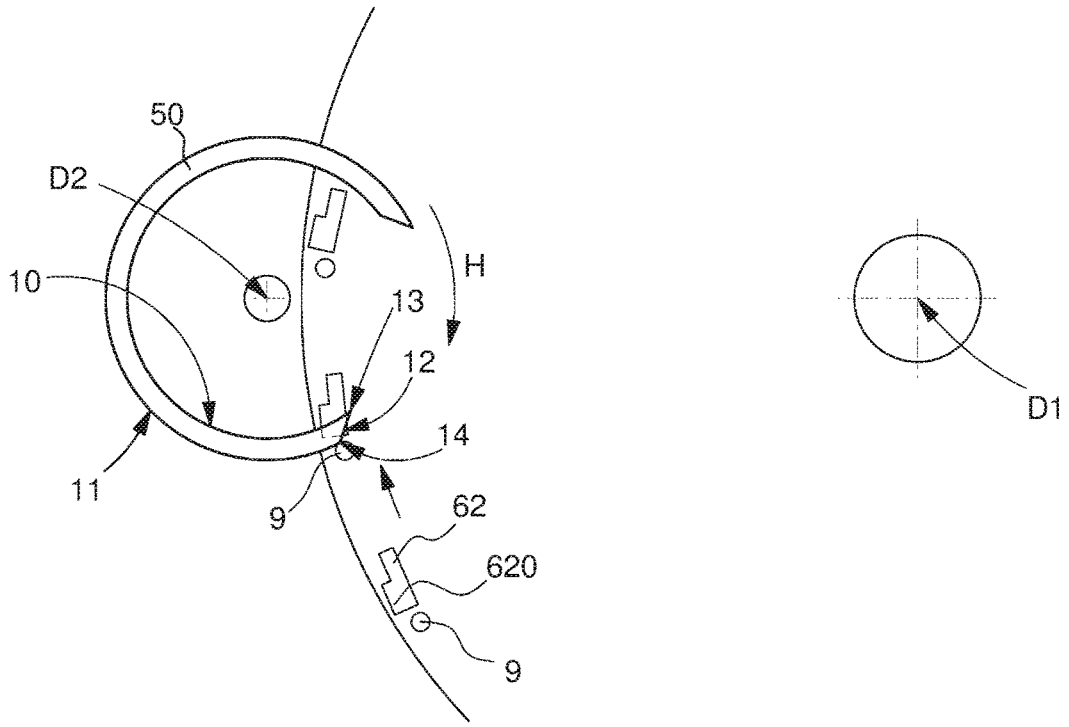
Figure 34:
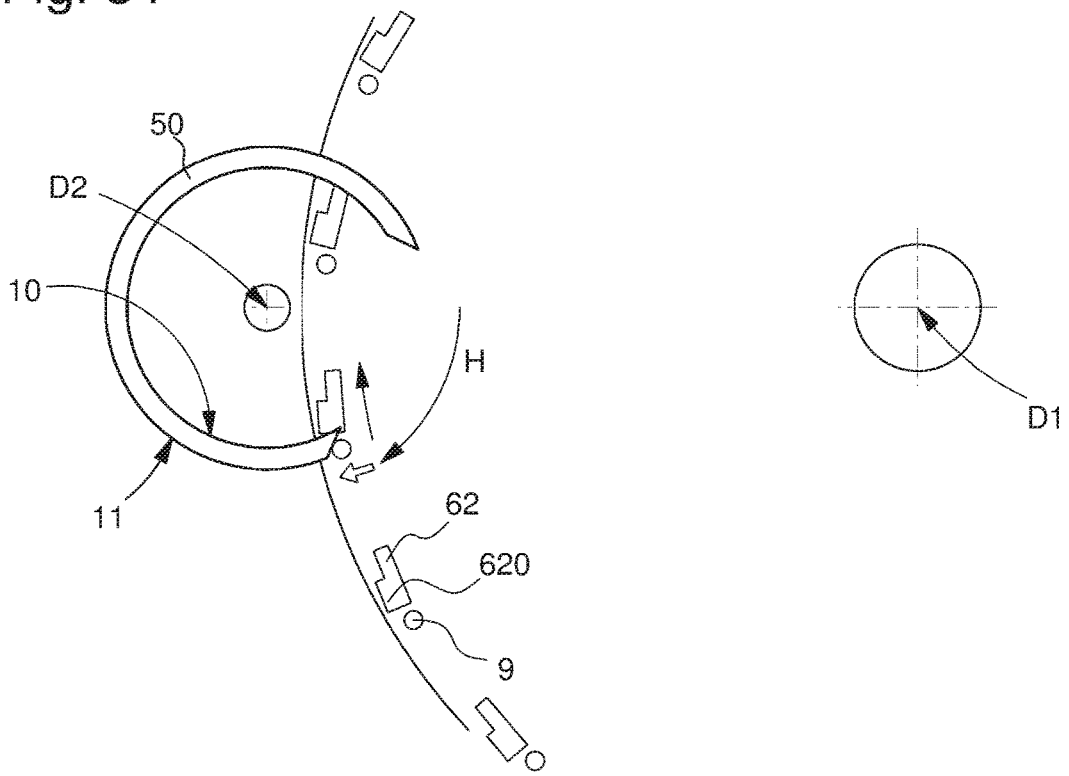
Figure 35:
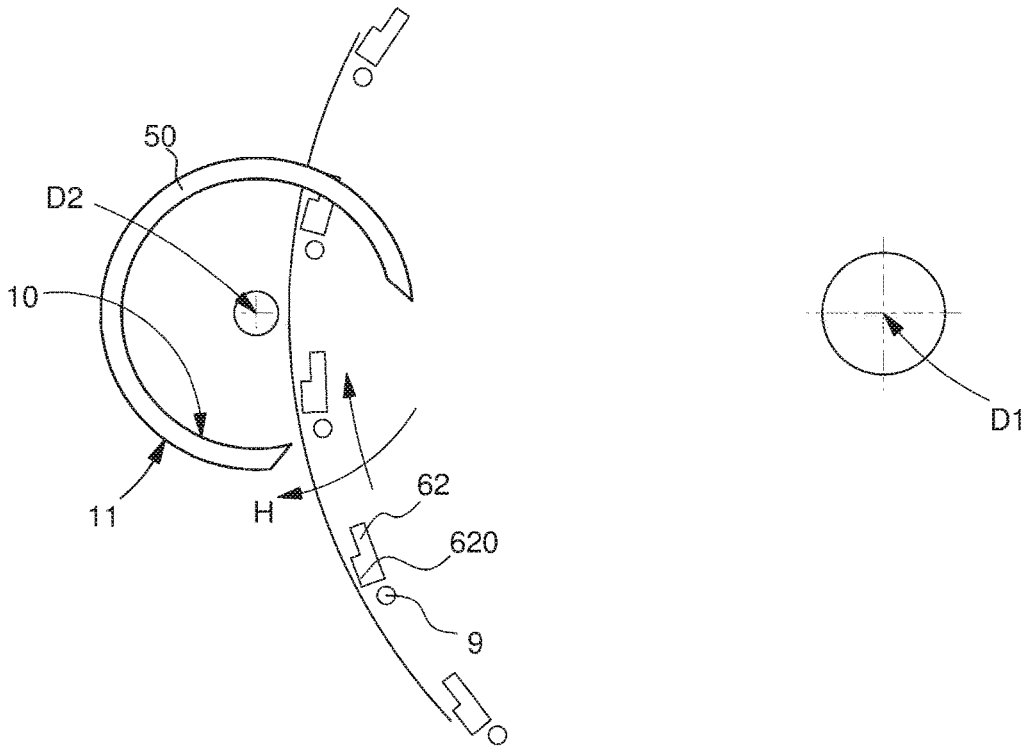

FIG. 30 shows a torque at the escape wheel which is higher than the nominal torque: in the case where the nominal torque is exceeded at the escape wheel, mechanical stop members 9 of actuator 6 prevent the system from losing synchronization. FIG. 32 illustrates, in the same case, the continued pivoting of the balance in clockwise direction H, with a mechanical stop member 9 resting on second complementary outer stop surface 11 of ring 50. FIG. 33 represents the instant preceding a so-called mechanical impulse, where mechanical stop member 9 rests on an outer beak 14 which marks the limit between second complementary outer stop surface 11 of ring 50 and joining surface 12. FIG. 34 then illustrates the role of tilted joining surface 12, of ring 50, which imparts a mechanical impulse in the same manner as in a conventional cylinder escapement. This ensures the operation of the system even in the event of excessive torque. FIG. 35 shows the end of this mechanical impulse.

The invention provides greater efficiency than in a conventional cylinder escapement. The chronometric properties of an escapement according to the invention are satisfactory.

The invention claimed is:

1. A timepiece escapement mechanism, comprising:

an escape wheel subjected to a rotational torque, having a lower or equal moment to a nominal moment, about a first pivot axis; and a resonator integral with a regulating wheel set mounted to pivot about a second real or virtual pivot axis;

the escape wheel including a plurality of actuators regularly spaced on a periphery thereof and each arranged to cooperate directly with at least a first track of the regulating wheel set;

wherein each actuator includes first magnetic or electrostatic stopping means forming a barrier and arranged to cooperate with the first track which is magnetically, or respectively electrically charged, or ferromagnetic, or respectively electrostatically conductive, to exert on the first track a torque having a moment greater than the nominal moment; and wherein each actuator further includes second stopping means arranged to constitute an end-of-travel stop, arranged to constitute an autonomous escapement mechanism with at least a first complementary stop surface included in the regulating wheel set.

2. The escapement mechanism according to claim 1, wherein the first stopping means comprises a surface, which is magnetically, or respectively electrically charged, or ferromagnetic, or respectively electrostatically conductive, forming a barrier, and arranged to cooperate with the first track which is magnetically, or respectively electrically charged, or ferromagnetic, or respectively electrostatically conductive, to create between the first track and each surface of the actuator a torque having a moment greater than the nominal moment.

3. The escapement mechanism according to claim 2, wherein the first stopping means includes, arranged to cooperate with the first track, a first surface for exerting a torque with a first moment lower than a second moment of a stopping torque exerted by a second surface forming a barrier where there is a magnetic, or respectively electrostatic field, of higher intensity than the magnetic, or respectively electrostatic field, present on the first surface, and the second surface is arranged to cooperate with at least a first complementary stop surface included in the regulating wheel set to constitute therewith an autonomous escapement mechanism.

4. The escapement mechanism according to claim 1, wherein the second stopping means includes a mechanical stop member arranged to cooperate, in an end-of-travel stop arrangement, with at least a first complementary stop surface included in the regulating wheel set, to constitute therewith an autonomous escapement mechanism.

5. The escapement mechanism according to claim 3, wherein the second stopping means comprises a mechanical stop member arranged to cooperate, in an end-of-travel stop arrangement with at least a first complementary stop surface included in the regulating wheel set to constitute therewith an autonomous escapement mechanism, and wherein each actuator comprises in series, in a single direction of entry into cooperation with the first track, a first surface, a second surface, and a mechanical stop member.

6. The escapement mechanism according to claim 1, wherein the escapement mechanism is a contactless dead beat escapement.

7. The escapement mechanism according to claim 1, wherein the actuators are identical to each other.

8. The escapement mechanism according to claim 1, wherein the first track is located on a sector of a body of revolution centered on the second pivot axis and with an angular amplitude strictly less than 360°.

9. The escapement mechanism according to claim 1, wherein the first complementary stop surface is carried by a truncated ring gear which is a sector of a body of revolution centered on the second pivot axis, and is of angular amplitude strictly less than 360°, to minimize exchange of energy between the resonator and the escape wheel, except close to an equilibrium position of the resonator.

10. The escapement mechanism according to claim 1, wherein the first track generates a first magnetic, or respectively electrostatic field, which tends to repel each first surface of the actuator, the first surface is magnetically, or respectively electrically charged in an opposite polarity to that of the first magnetic, or respectively electrostatic field.

11. The escapement mechanism according to claim 1, wherein each actuator includes a first magnetically, or respectively electrically charged surface, arranged to cooperate with the first track which is magnetically, or respectively electrically charged, to attract each first surface of the actuator.

12. The escapement mechanism according to claim 1, wherein the escape wheel comprises other actuators, each comprising at least a second magnetically, or respectively electrically charged surface, arranged to cooperate with a second track of the regulating wheel set, the second track being parallel to the first track, and perpendicular to the second pivot axis, and is an annular sector centered on the second pivot axis and with an angular amplitude strictly less than 360°, and generates a second magnetic, or respectively electrostatic field, which tends to repel each second surface magnetically, or respectively electrically charged with an opposite polarity to that of the second magnetic, or respectively electrostatic field.

13. The escapement mechanism according to claim 12, wherein the escape wheel comprises at least an upper disc including first surfaces, and a lower disc including second surfaces located perpendicular to and facing the first surfaces, and wherein the escape wheel comprises magnetic, or respectively electrostatic field closing means, between the upper disc and the lower disc and the first magnetically, or respectively electrically charged track is formed of a series of magnetically, or respectively electrically charged studs, and wherein the second magnetically, or respectively electrically charged track, is formed of a series of magnetically, or respectively electrically charged studs.

14. The escapement mechanism according to claim 5, wherein each mechanical stop member is further arranged to cooperate, in an end-of-travel stop arrangement, with at least a second complementary stop surface included in the regulating wheel set, and further wherein the second complementary stop surface is carried by a surface of revolution centered on the second pivot axis, and is of angular amplitude strictly less than 360°.

15. The escapement mechanism according to claim 14, wherein the second complementary stop surface is connected to the first complementary stop surface by at least one joining surface, arranged to form an impulse ramp for the resonator when the joining surface abuts on the actuator arranged to provide energy to the resonator close to an equilibrium position thereof.

16. The escapement mechanism according to claim 4, wherein the mechanical stop member comprises an impulse ramp arranged to provide energy to the resonator close to the equilibrium position thereof.

17. The escapement mechanism according to claim 15, wherein the impulse ramp only provides energy to the resonator close to the equilibrium position thereof if a drive torque imparted to the escape wheel is such that repulsion, or respectively attraction, between the first track and each first surface of the actuator, is insufficient to prevent contact between the mechanical stop member and the regulating wheel set.

18. The escapement mechanism according to claim 16, wherein the impulse ramp only provides energy to the resonator close to the equilibrium position thereof if a drive torque imparted to the escape wheel is such that the repulsion, or respectively attraction, between the first track and each first surface of the actuator, is insufficient to prevent contact between the mechanical stop member and the regulating wheel set.

19. The escapement mechanism according to claim 1, wherein each first magnetically, or respectively electrically charged surface comprises a section that gradually decreases in the radial direction away from the first pivot axis, so that an area of a superposition surface corresponding to a projection of a first surface onto the first track is variable during relative pivoting of the escape wheel and the regulating wheel set.

20. The escapement mechanism according to claim 1, wherein the escape wheel gradually provides energy to the system, and wherein the regulating wheel set returns accumulated energy instantaneously, in a form of an impulse imparted to the resonator, the escapement mechanism thus forming a constant force escapement mechanism.

21. The escapement mechanism according to claim 14, wherein the escapement mechanism constitutes a cylinder escapement mechanism, wherein the first complementary stop surface is an inner surface of a cylindrical tubular sector, and wherein the second complementary stop surface is an outer surface of the cylindrical tubular sector.

22. The escapement mechanism according to claim 15, wherein the escapement mechanism constitutes a cylinder escapement mechanism, wherein the first complementary stop surface is an inner surface of a cylindrical tubular sector, and wherein the second complementary stop surface is an outer surface of the cylindrical tubular sector.

23. The escapement mechanism according to claim 14, wherein the escapement mechanism constitutes a pin wheel escapement mechanism, wherein the escape wheel comprises a half pin on each actuator, and wherein the first complementary stop surface is an inner surface of a first drawing compass link member, and wherein the second complementary stop surface is an outer surface of a second drawing compass link member, the inner surface of the first drawing compass link member and the outer surface of the second drawing compass link member being separated by a space of width greater than the radius of the half pin.

24. The escapement mechanism according to claim 15, wherein the escapement mechanism constitutes a pin wheel escapement mechanism, wherein the escape wheel comprises a half pin on each actuator, and wherein the first complementary stop surface is an inner surface of a first drawing compass link member, and wherein the second complementary stop surface is an outer surface of a second drawing compass link member, the inner surface of the first drawing compass link member and the outer surface of the second drawing compass link member being separated by a space of width greater than the radius of the half pin.

25. The escapement mechanism according to claim 1, wherein the escapement mechanism is devoid of a stop member.

26. A timepiece movement comprising at least one escapement mechanism according to claim 1 and drive motor means subjecting the escape wheel to a unidirectional rotational torque about the first pivot axis, wherein the drive motor means is arranged to deliver a torque sufficient to allow complete superposition of each first surface with the first track.

27. The timepiece movement according to claim 26, wherein the escapement mechanism is devoid of stop members, and wherein maximum torque delivered by the drive motor means is limited to a level that is insufficient to allow complete superposition of each barrier with the first track.

28. A timepiece comprising a timepiece movement according to claim 26.

* * * * *